US011959370B2

(12) United States Patent
Ellis et al.

(10) Patent No.: US 11,959,370 B2
(45) Date of Patent: Apr. 16, 2024

(54) CONVERTIBLE TRACER VALVE ASSEMBLIES AND RELATED METHODS FOR FRACTURING AND TRACING

(71) Applicants: NCS MULTISTAGE INC., Calgary (CA); NCS MULTISTAGE, LLC, Houston, TX (US)

(72) Inventors: Dustin Ellis, Houston, TX (US); Shan Zi, Houston, TX (US); John Ravensbergen, Calgary (CA); Craig Harty, Calgary (CA); Brock Gillis, Calgary (CA); Stanley Mberia, Calgary (CA); Anna Cruse, Houston, TX (US); Rio Whyte, Calgary (CA)

(73) Assignees: NCS MULTISTAGE INC., Calgary (CA); NCS MULTISTAGE, LLC., Houston, TX (US); REPEAT PRECISION, LLC., Houston, TX (US)

( * ) Notice: Subject to any disclaimer, the term of this patent is extended or adjusted under 35 U.S.C. 154(b) by 30 days.

(21) Appl. No.: 17/782,334

(22) PCT Filed: Apr. 24, 2020

(86) PCT No.: PCT/CA2020/050540

§ 371 (c)(1),
(2) Date: Jun. 3, 2022

(87) PCT Pub. No.: WO2021/108891

PCT Pub. Date: Jun. 10, 2021

(65) Prior Publication Data

US 2023/0003110 A1 Jan. 5, 2023

Related U.S. Application Data

(60) Provisional application No. 62/944,002, filed on Dec. 5, 2019.

(51) Int. Cl.

| | |
|---|---|
| ***E21B 43/26*** | (2006.01) |
| ***E21B 34/14*** | (2006.01) |
| ***E21B 47/11*** | (2012.01) |

(52) U.S. Cl.
CPC ..... *E21B 43/26* (2013.01); *E21B 34/14* (2013.01); *E21B 47/11* (2020.05); *E21B 2200/06* (2020.05)

(58) Field of Classification Search
CPC ..... E21B 43/26; E21B 47/11; E21B 43/14; E21B 2200/06; E21B 34/14
See application file for complete search history.

(56) References Cited

U.S. PATENT DOCUMENTS

| | | | |
|---|---|---|---|
| 8,596,354 | B2 | 12/2013 | Hartshorne et al. |
| 9,133,683 | B2 | 9/2015 | Dyer et al. |
| 2020/0263535 | A1* | 8/2020 | Roessler ..... E21B 47/09 |

FOREIGN PATENT DOCUMENTS

| | | | |
|---|---|---|---|
| CA | 2870609 | A1 | 10/2013 |
| CN | 101418683 | A | 4/2009 |
| WO | 2019183713 | A1 | 10/2019 |

OTHER PUBLICATIONS

Canadian Intellectual Property Office, International Search Report for PCT/CA2020/050540, dated Jul. 27, 2020, 3 pages.

* cited by examiner

*Primary Examiner* — Zakiya W Bates
(74) *Attorney, Agent, or Firm* — UB Greensfelder LLP; Richard C. Himelhoch

(57) ABSTRACT

A valve assembly for integration within a wellbore string disposed within a hydrocarbon-containing reservoir is provided. The valve assembly includes a valve housing having a plurality of frac ports for establishing fluid communication between a central passage and the reservoir. The valve assembly includes a bottom sleeve operatively mounted within the valve housing configured to selectively open the frac ports, and a top sleeve operatively mounted within the valve housing slidable between (i) a first position defining a first fluid pathway whereby fluid is flowable down into the central passage and into the reservoir via the frac ports, and (ii) a tracing position defining a second fluid pathway (Continued)

whereby fluid is flowable from the reservoir into an annulus defined between the top sleeve and the housing. The valve assembly also has a tracer compartment defined within the annulus forming part of the second fluid pathway and accommodating a tracer material.

26 Claims, 13 Drawing Sheets

CONVERTIBLE TRACER VALVE ASSEMBLIES AND RELATED METHODS FOR FRACTURING AND TRACING

CROSS-REFERENCE TO RELATED APPLICATIONS

The present application is a U.S. national stage application of International Application No. PCT/CA2020/050540, filed Apr. 24, 2020, which claims priority to and the benefit of U.S. Provisional Patent Application No. 62/944,002, filed Dec. 5, 2019, the contents of which are incorporated herein by reference and made a part hereof.

TECHNICAL FIELD

The technical field generally relates to apparatuses, systems and methods for fracturing formations and producing hydrocarbons from a hydrocarbon-containing reservoir.

BACKGROUND

Fracturing formations can be performed using various methods, some of which can use slidable frac sleeves to allow the fracturing fluid to access the formation via fracturing ports that can be exposed during fracturing and then closed. Once the fracturing operation has been completed, production ports can be opened to allow hydrocarbons to flow from the reservoir into the well and up to the surface. In addition, it can be desirable to deploy tracers in the formation in order to monitor hydrocarbon or water production. For example, tracer materials can be used to determine if a certain stage along a wellbore is effectively producing oil. Tracer materials are conventionally added to the fracturing fluid and are therefor supplied with the liquid and proppant from the surface, down the well and then into the fractured stage. The tracer is thereby carried into the reservoir where it can associate with reservoir oil or water so as to be detectable in the production fluid in order to facilitate monitoring. Tracers can be used, for example, to confirm whether successful fracturing of each stage along the well has been achieved. However, there are a number of challenges with deploying and detecting tracers and there is a need for improved technologies in this space.

SUMMARY

According to an aspect, a fracturing and tracer-delivery valve assembly for integration within a wellbore string disposed within a hydrocarbon-containing reservoir is provided. The valve assembly includes a valve housing having a tubular wall defining a central passage therethrough and a plurality of frac ports extending through the tubular wall for establishing fluid communication between the central passage and the reservoir, a bottom sleeve operatively mounted within the valve housing and slidable within the central passage between a closed position and an open position to selectively open the frac ports, the bottom sleeve having a channel therethrough, and a top sleeve operatively mounted within the valve housing uphole of the bottom sleeve, the top sleeve and the valve housing defining an annulus therebetween. The top sleeve has uphole and downhole ends and a channel provided therethrough and is slidable within the central passage between (i) a first position defining a first fluid pathway whereby fluid is flowable down into the central passage at an uphole end of the housing, through the channel of the top sleeve and into the reservoir via the frac ports, and (ii) a tracing position defining a second fluid pathway whereby fluid is flowable from the reservoir into the annulus, upward along the annulus, and then into the central passage of the valve housing proximate an uphole end of the top sleeve. The valve assembly further includes a tracer compartment defined within the annulus and accommodating a tracer material, wherein in the first position, the uphole and downhole ends of the top sleeve are in sealing engagement with the valve housing to define the tracer compartment as a sealed section of the annulus that is isolated from fluid flowing along the first fluid pathway, and in the tracing position, the tracer compartment forms part of the second fluid pathway.

According to a possible implementation, when in the tracing position, the frac ports are in fluid communication with the reservoir and the annulus to establish flow into the annulus.

According to possible implementations, the bottom sleeve is shiftable downhole to open the frac ports, and the top sleeve is shiftable downhole to move from the first position to the tracing position.

According to a possible implementation, the top and bottom sleeves are configured such that moving the top sleeve from the first position to the tracing position pushes the bottom sleeve from the closed position to the open position.

According to a possible implementation, the top sleeve includes a plurality of production ports through a tubular wall thereof proximate the uphole end thereof for establishing fluid communication between the annulus and the central passage of the valve housing.

According to a possible implementation, the production ports are occluded when the top sleeve is in the first position.

According to a possible implementation, the uphole and downhole ends of the top sleeve are in sealing engagement with the housing when in the tracing position to prevent fluid from entering the tracer compartment during flow of fracturing fluid via the first fluid pathway.

According to a possible implementation, the uphole end of the top sleeve is press-fitted within an upper portion of the valve housing when in the tracing position, and the downhole end of the top sleeve is in sealing engagement with the valve housing via at least one annular seal provided therebetween.

According to a possible implementation, the fracturing and tracer-delivery valve assembly further includes a pair of sealing rings provided on either side of the frac ports, the sealing rings being configured to sealingly engage at least one of the top and bottom sleeves.

According to a possible implementation, at least one of the sealing rings engages the top sleeve when in the tracing position.

According to a possible implementation, at least one of the sealing rings engages the bottom sleeve when in the closed position.

According to a possible implementation, the top sleeve includes an inlet portion proximate the downhole end opposite the frac ports, the inlet portion being recessed to facilitate fluid flow from the reservoir to the annulus.

According to a possible implementation, the top sleeve and the valve housing are substantially concentric.

According to a possible implementation, the tracer material is provided in a carrier within the tracer compartment.

According to a possible implementation, the carrier is a polymer matrix.

According to a possible implementation, the tracer material includes at least one of a water-soluble tracer material, a hydrocarbon-soluble tracer material and a gas-soluble tracer material.

According to a possible implementation, the tracer material is provided uniformly within the tracer compartment.

According to a possible implementation, the tracer material is provided on an outer surface of the top sleeve within the tracer compartment.

According to a possible implementation, the tracer material is provided on an inner surface of the valve housing within the tracer compartment.

According to a possible implementation, the tracer material is provided in the form of at least one strip comprising the tracer material.

According to a possible implementation, the at least one strip is a plurality of strips. According to a possible implementation, the strips are arranged longitudinally. According to a possible implementation, the strips are arranged on the outer surface of the top sleeve and are evenly spaced apart from each other around the top sleeve.

According to a possible implementation, the strips of tracer material are at least partially embedded in the top sleeve.

According to a possible implementation, one or more strips include a type of tracer material differing from the type of tracer material of an adjacent strip within the tracer compartment.

According to a possible implementation, the tracer material is provided as part of a tracer coating applied to the top sleeve and/or the valve housing within the tracer compartment.

According to a possible implementation, the tracer coating of tracer material has a thickness between about 0.02 and 0.12 inches.

According to a possible implementation, the tracer coating includes a plurality of layers.

According to a possible implementation, each layer includes a different tracer material.

According to a possible implementation, the layers of tracer material are superposed, longitudinally side-by-side, laterally side-by-side, or a combination thereof.

According to a possible implementation, the tracer material includes high sensitivity tracer material allowing for parts-per-billion or lower detection. The high sensitivity tracer material could also be provided to enable parts-per-trillion detection (e.g., gas tracers or DNA type tracers that can be detected at $10^{-15}$ levels (ppg or fM).

According to a possible implementation, the valve housing is cemented within the wellbore.

According to another aspect, a wellbore completion assembly is provided. The wellbore completion assembly includes a wellbore string disposed within a hydrocarbon-containing reservoir; and a plurality of fracturing and tracer-delivery valve assemblies as defined above, arranged in spaced-apart relation along the wellbore.

According to a possible implementation, each valve assembly includes at least one unique tracer material or a unique combination of tracer materials.

According to a possible implementation, the fracturing and tracer-delivery valve assemblies are cemented into the wellbore.

According to a possible implementation, the fracturing and tracer-delivery valve assemblies are configured for multistage fracturing and multistage tracing.

According to yet another aspect, a fracturing and tracer-delivery valve assembly for integration within a wellbore string disposed within a hydrocarbon-containing reservoir is provided. The valve assembly includes a valve housing having a wall, a passage extending therethrough, and at least one frac port extending through the wall for establishing fluid communication between the passage and the reservoir, a first sleeve operatively mounted within the valve housing and displaceable within the passage between a closed position and an open position to selectively open the at least one frac port, the first sleeve having a channel therethrough, and a second sleeve operatively mounted within the valve housing and being displaceable within the passage between (i) a first position defining a first fluid pathway whereby fluid is flowable through the passage and into the reservoir via the at least one frac port, and (ii) a tracing position defining a second fluid pathway whereby fluid is flowable from the reservoir into the valve assembly and then up to surface. The valve assembly also includes a tracer compartment defined within the second fluid pathway and accommodating a tracer material, wherein in the first position, the tracer compartment is sealed and isolated from fluid flowing along the first fluid pathway, and in the tracing position, the tracer compartment forms part of the second fluid pathway.

According to still another aspect, a method of fracturing a formation and tracing production fluid via a single downhole multifunctional valve assembly is provided. The method includes deploying the valve assembly within a wellbore provided in a hydrocarbon-bearing formation, the valve assembly being configured to define a fracturing fluid pathway into the formation and an enclosed tracer compartment comprising a tracer material sealed therein. The method also includes delivering fracturing fluid into the wellbore and through the fracturing fluid pathway to enter and fracture the hydrocarbon-bearing formation, closing the fracturing fluid pathway after fracturing, opening the tracer compartment to provide a tracing fluid pathway for production fluid to flow from the hydrocarbon-bearing formation, along the tracer compartment to allow contact with and release of the tracer material, and then into the wellbore to enable flow up to surface.

According to a possible implementation, the valve assembly is as defined above, and wherein the fracturing fluid pathway is the first fluid pathway and the tracing fluid pathway is the second fluid pathway.

According to a possible implementation, the valve assembly has at least (a) a run-in or closed configuration wherein fluid is prevented from being injected into the reservoir, (b) a fracturing configuration where frac ports are open and fracturing fluid can be injected via the first fluid pathway into the reservoir, and (c) a tracing configuration where production fluid is allowed to flow through the second pathway and then up to surface.

According to a possible implementation, the fracturing configuration further allows production of production fluid from the reservoir via the first fluid pathway in production mode without tracing.

According to a possible implementation, deploying the valve assembly within a wellbore includes cementing the valve assembly in the wellbore.

According to a possible implementation, the valve assembly includes movable components that are displaced to transition (i) from the run-in configuration to the fracturing configuration, (ii) from the fracturing configuration to the closed configuration, and (iii) from the closed configuration to the tracing configuration.

According to a possible implementation, the movable components include sleeves that are shifted axially between different positions to provide the configurations (a) to (c).

According to a possible implementation, the method further includes, after delivering fracturing fluid into the wellbore to fracture the reservoir and before opening the tracer compartment, flowing production fluid from the reservoir and through the valve assembly via the fracturing fluid pathway operated in production mode.

According to a possible implementation, the production fluid is recovered via the fracturing fluid pathway operated in production mode when no tracing is provided, and via the tracing fluid pathway when tracing is provided.

According to another aspect, a fracturing and tracer-delivery valve assembly for integration within a wellbore string disposed within a hydrocarbon-containing reservoir is provided. The valve assembly includes a valve housing comprising a wall, a passage extending therethrough, and at least one frac port extending through the wall for establishing fluid communication between the passage and the reservoir, a first sleeve operatively mounted within the valve housing and displaceable within the passage between a closed position and an open position to selectively open the at least one frac port, the first sleeve having a channel therethrough, and a second sleeve operatively mounted within the valve housing and being displaceable within the passage between (i) a first position in which a first fluid pathway is formed whereby fluid is flowable through the passage and into the reservoir via the at least one frac port, and (ii) a tracing position defining a second fluid pathway whereby fluid is flowable from the reservoir via the at least one frac port into the valve assembly and then up to surface. The valve assembly also includes a tracer compartment defined within the second fluid pathway and accommodating a tracer material.

According to a possible embodiment, the first fluid flow path and the second fluid flow path have at least one shared port, and the at least one shared port is the at least one frac port.

According to yet another aspect, a fracturing and tracer-delivery valve assembly for integration within a wellbore string disposed within a hydrocarbon-containing reservoir is provided. The valve assembly includes a valve housing comprising a wall, a passage extending therethrough, and at least one frac port extending through the wall for establishing fluid communication between the passage and the reservoir, a flow path sub-assembly disposed within the housing and configured to move between at least (i) a first position defining a fracturing flow path whereby fluid is flowable through the passage and into the reservoir via the at least one frac port, and (ii) a tracing position defining a second fluid pathway whereby production fluid is flowable from the reservoir into the valve assembly and then up to surface. The valve assembly further has a tracer compartment present within and/or in fluid communication with the second fluid pathway in the tracing position, the tracer compartment accommodating a tracer material.

According to a possible implementation, the second fluid pathway is configured such that the production fluid flows from the reservoir via the at least one frac port into the valve assembly.

According to a possible implementation, the flow path sub-assembly includes displacement members that move to provide the first and second positions.

According to a possible implementation, the displacement members comprise axial displacement members that are displaced axially within the housing in order to provide the first and second positions.

According to a possible implementation, the displacement members are configured such that the fracturing flow path passes through a central channel and out through a port in housing, and the second fluid pathway passes through a port in housing and through an annular region defined between an inner surface of the housing and an opposed wall.

According to a possible implementation, the flow path sub-assembly is moved between the first and second positions using mechanical, remote, or electrical actuation.

According to a possible implementation, the flow path sub-assembly is moved between the first and second positions using a setting tool deployed down the wellbore.

According to a possible implementation, the axial displacement members comprise sliding sleeves.

According to a possible implementation, the flow path sub-assembly comprises sleeves as defined above.

According to a possible implementation, the tracer material includes an oligonucleotide.

According to a possible implementation, the tracer material includes a molecule that is amplifyable at surface.

According to a possible implementation, the tracer material has low detectability in parts per billion orlower concentration.

According to another aspect, a method of quantifying fluid production from a reservoir using a convertible downhole valve assembly having a fracturing fluid pathway and a production fluid pathway isolated from one another, the production fluid pathway being provided with tracer material is provided. The method includes injecting fracturing fluid into the reservoir via the fracturing fluid pathway, recovering a combined production fluid from the reservoir, wherein the combined production fluid comprises production fluid comprising released tracer and obtained from the downhole valve assembly obtained via the production fluid pathway, wherein the production fluid pathway has a predetermined geometry and the tracer material has predetermined release characteristics, and analyzing the released tracer present in the combined production fluid at surface based on the predetermined geometry and the predetermined release characteristics to determine at least one quantitative property of the production fluid that passed through the downhole valve assembly.

According to a possible implementation, the production fluid pathway is defined by the valve assembly as above.

According to a possible implementation, the at least one quantitative property of the production fluid comprises a flow rate of the production fluid.

According to a possible implementation, the at least one quantitative property of the production fluid comprises a flow rate of an oil phase of the production fluid.

According to a possible implementation, the at least one quantitative property of the production fluid comprises a flow rate of a water phase of the production fluid.

According to a possible implementation, the method includes building a calibration model regarding the predetermined geometry and the predetermined release characteristics, and using the calibration model to determine the at least one quantitative property based on a measured concentration of the tracer in the combined production fluid.

According to a possible implementation, the predetermined release characteristics of the tracer include desorption properties in response to fluid flow conditions.

According to yet another aspect, a fracturing and tracer-delivery valve assembly for integration within a wellbore string disposed within a hydrocarbon-containing reservoir is provided. The valve assembly includes a valve housing comprising a wall, a passage extending therethrough, and at least one frac port extending through the wall for establishing fluid communication between the passage and the reservoir, a flow path sub-assembly disposed within the housing and configured to move between at least (i) a first position defining a fracturing flow path whereby fluid is flowable through the passage and into the reservoir via the at least one frac port, and (ii) a tracing position defining a second fluid pathway whereby production fluid is flowable from the reservoir into the valve assembly and then up to surface. The valve assembly also has a tracer compartment present within and/or in fluid communication with the second fluid pathway in the tracing position, the tracer compartment accommodating a tracer material comprising molecules that are amplifyable and/or amenable to concentration at surface, a compound that has low detectability in parts per billion or lower concentration, and/or an oligonucleotide.

According to another aspect, a fracturing and tracer-delivery valve assembly for integration within a wellbore string disposed within a hydrocarbon-containing reservoir is provided. The valve assembly includes a valve housing comprising a wall, a passage extending therethrough, and at least one frac port extending through the wall for establishing fluid communication between the passage and the reservoir. The valve assembly also includes a valve sleeve operatively mounted within the valve housing and displaceable within the passage between a closed position, an open position to open the at least one frac port and define a first fluid pathway whereby fluid is flowable through the passage and into the reservoir via the at least one frac port, and a tracing position defining a second fluid pathway whereby fluid is flowable from the reservoir into the valve assembly and then up to surface. The valve assembly further includes a tracer compartment defined within the second fluid pathway and accommodating a tracer material, wherein, when in the closed and open positions, the tracer compartment is sealed and isolated from fluid flowing along the first fluid pathway, and in the tracing position, the tracer compartment forms part of the second fluid pathway.

In addition, while the techniques and devices described herein are described for implementation in hydrocarbon-containing reservoirs for hydrocarbon recovery, it should be noted that they could also be adapted for use in other types of formations or reservoirs in the context of recovering other valuable materials. For example, the techniques and devices could be used in salt-water containing formations for recovering materials such as lithium or other valuable salts. When operating the devices in brine containing formations, the tracer materials can be selected accordingly and operating the devices can also be adapted in terms of the injection fluids and other operational features.

It should be noted that various aspects and implementations as described above can be combined with one or more other features that are described or illustrated in the present application.

BRIEF DESCRIPTION OF THE DRAWINGS

FIG. 15 showing the valve in a closed configuration, FIG. 16 showing the valve in an open configuration, and FIG. 17 is showing the valve in a tracing configuration, according to possible implementations.

FIG. 18 showing the valve in a closed configuration, FIG. 19 showing the valve in an open configuration, and FIG. 20 is showing the valve in a tracing configuration, according to possible implementations.

DETAILED DESCRIPTION

Figure 1:
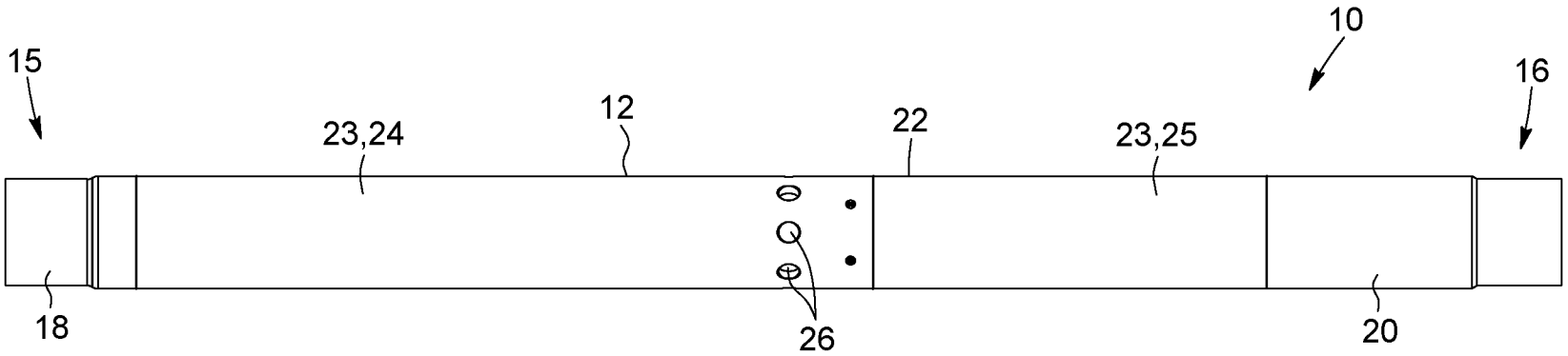
FIG. 1 is a side view of a valve assembly according to an implementation.

As will be described below in relation to various implementations, a convertible valve assembly is provided and enables fracturing of a surrounding stage of a formation and also delivering tracer material into the production fluid for recovery at surface during production.

Broadly described, the valve assembly is configured to be integrated as part of a wellbore string disposed within a hydrocarbon-containing reservoir. The valve assembly is operable between various configurations for allowing fracturing fluid to be injected within the reservoir, and production fluid to be produced from the reservoir via the same wellbore string. In other words, the valve assembly is configured to allow both fracturing and production operations within the reservoir. The valve can also include a tracer compartment in which a tracer material, or various tracer materials, is provided so that the tracer can be deployed within the valve assembly instead of being pumped downhole as part the fracturing fluid. The valve assembly can be configured to provide a first flow pathway to enable flow of fracturing fluid to enable fracturing, and a second flow pathway that accommodates tracer material and is configured to receive production fluid during the production operation and allow tracer to be entrained with the production fluid.

The valve assembly is thus multifunctional, enabling fracturing and tracing of production fluid, while facilitating deployment of tracer material that is pre-packaged within the valve assembly. The valve assembly can be shifted, or otherwise moved, into different configurations to provide the first or second flow pathways at different stages of the operation. As will be described further below, it should be understood that the first and second flow pathways can be defined by two partially independent passages along which fluid can flow. In other words, and for example, the first and second flow pathways are not identical (e.g., structurally), but can share common components, such as inlets.

More specifically, in some implementations, the valve assembly includes a valve housing having a central passage therethrough and a plurality of frac ports extending radially through a tubular wall of the housing for establishing fluid communication between the passage and the reservoir. The valve assembly further includes a pair of sleeves, which can be slidably mounted within the housing and configured to selectively close and open the frac ports. The housing and the sleeves also define at least two fluid pathways isolated from one another along which fluid flows to and from the reservoir. As will be described further below, one of the pathways includes a tracer compartment provided with tracer material configured to be recovered by the fluid flowing through it. The tracer material can then be recovered in the production fluid at surface and can be analyzed in order to assess or quantify the fluids recovered from the reservoir.

It will be understood that the valve assembly described herein can be used in relation with multistage fracturing (also referred to as "fracking") operations. The fracturing operation can include a number of steps, some of which are described below.

In fracturing operations, the wellbore can first be dug out (e.g., drilled) and lined with casing, and then cement slurry can be pumped down the casing towards a toe of the wellbore and back up an annulus defined between the casing and the reservoir (i.e., the walls of the wellbore). In order to push the cement slurry past the toe and into the annulus, a wiper plug can be pumped down the casing to effectively wipe the slurry from the interior of the wellbore. Once within the annulus, the cement can be allowed to cure, thus cementing the casing within the wellbore.

In "plug and perf" fracturing operations, a perforating gun is lowered down the casing and fired to form perforations through the casing at the lowest stage of the well. Then fracturing fluid is pumped down to fracture the reservoir through those perforations. A plug can then be placed above (i.e., uphole) the fractured perforations, and the process can be repeated one stage up, and so on, up the wellbore.

In the context of the present disclosure, instead of forming perforations as in "plug and perf" operations, the valve assembly can be installed between lengths of casing at desired locations. These locations can be determined based on where the perforations would have been if a perforating gun was used. After the casing and valve assemblies are in place in the open wellbore, the casing and valve assemblies are cemented in place using cementing techniques such as those noted above. The cementing process can interfere with the operation of the sleeves or other moving parts of the valve assembly. The sleeves can therefore be designed to accommodate the cementing process whereby cement is prevented from entering any ports, slots, recesses and the like, that might not be cleaned by the wiper plug, for example. Furthermore, in order to prevent the sleeves from being moved by the wiper plug (or by subsequent well equipment, cleaning, etc.), the sleeves can be held in position by shear pins or other securing mechanisms, as will be described further below. Therefore, in some implementations, to actuate the sleeves, a first shift force is required to break the pins and move the sleeves.

In some implementations, each stage of the wellbore can be provided with a corresponding valve assembly allowing fracturing of and production from the reservoir at each stage along the wellbore. The valve assemblies can be installed downhole between lengths of casing, cemented in place, and shifted using appropriate downhole tools, such as shifting tools deployed on coiled tubing, for example.

Figure 1A:
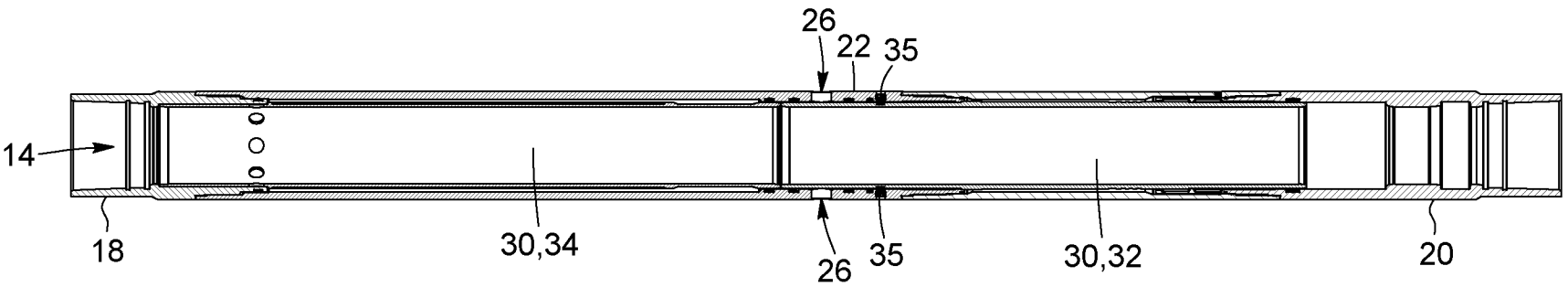
FIG. 1A is a cross-sectional view of the valve assembly of FIG. 1, showing a pair of sleeves mounted within a housing in a closed configuration, according to an implementation.

Referring to FIGS. 1 and 1A, an example implementation of the valve assembly 10 is illustrated. As mentioned above, the valve assembly 10 includes a casing or housing 12 having a central passage 14 for allowing fluid flow therethrough. The housing 12 has an uphole end 15 and a downhole end 16 configured to be connected between lengths of casing in order to integrate the valve assembly within the wellbore string, which is typically cemented in place. It should be understood that, as used herein, the expressions "uphole" and "downhole" refer to directional/orientational expressions using the configuration of the wellbore as reference. More specifically, the uphole direction is generally the direction leading to the surface, and the downhole direction is generally the direction leading away from the surface. Moreover, with reference to FIGS. 1 to 6, 8 and 9, the uphole direction is generally towards the left, while the downhole direction is generally towards the right.

It is noted that the casing sections are not illustrated in FIGS. 1 to10, but would be located on either end of the valve assembly 10 and can be coupled to the opposed ends of the housing 12, for example. During the cementing process, the cement can pass within the annulus defined between the wellbore and the casing for casing segments and within the annulus defined between the wellbore and the housing where the valve assemblies are located. The cement can thus form a continuous mass that surrounds and adheres to the outer surfaces of the casing and the housing 12.

In some implementations, the housing 12 can include a plurality of sections, or "subs", configured to connect to one another in an end-to-end fashion, although it is appreciated that other configurations and constructions are possible. It should be understood that, in the context of the present disclosure, the expression "sub" refers to a division or part of an ensemble or structure. More particularly, the housing 12 can include a top sub 18 provided at the uphole end 15, a bottom sub 20 provided at the downhole end 16, and a central sub 22 disposed between the top and bottom subs 18, 20. The top and bottom subs 18, 20 can be shaped and configured to be connected to corresponding parts of the wellbore string. For example, the top and bottom subs 18, 20 can be threaded in order to connect to corresponding threaded parts of the wellbore string. Alternatively, the top and bottom subs can be shaped and sized for insertion within the wellbore string via a press-fit connection.

The subs are illustratively connected to each other via outer tubular sections, or barrels 23, with a top barrel 24 and a bottom barrel 25 connecting the central sub 22 to the top and bottom subs 18, 20 respectively. It is noted that the passage 14 extends through each sub and barrel such that fluid flow remains unimpeded between the uphole and downhole ends 15, 16 of the housing 12. The barrels can be connected to the subs using any suitable method or configuration. For example, the barrels can be threaded onto the subs or connected thereto via press-fit, although it is appreciated that other connection methods are possible.

In this illustrated implementation, the housing 12 further includes a plurality of frac ports 26 extending radially about the housing 12 for establishing fluid communication between the passage 14 and the surrounding reservoir. It is appreciated that the housing 12 can include any suitable number of frac ports 26, and that the frac ports can be evenly or unevenly spaced and/or aligned about the housing 12, although other configurations are possible. In the illustrated implementations, there are eight frac ports (seen in FIGS. 7 and 10) evenly distributed about the circumference of a part of the housing, although it is appreciated that any other suitable number of frac ports can be used. It is also possible to have a single frac port instead of several. In the illustrated implementation, the frac ports 26 extend through the central sub 22. Alternatively, or additionally, the frac ports 26 can extend through the top sub 18, the bottom sub 20, or any other suitable location of the housing 12, or combination thereof. In alternate implementations, the valve housing 12 can be made as a single-piece unit (i.e., with no separate subs and barrels). However, having a plurality of subs and/or barrels can facilitate manufacturing of certain features of the valve assembly 10, such as the frac ports 26, for example. The frac ports can also have different cross-sectional areas and shapes, e.g., cylindrical, frustoconical, tapered toward or away from the reservoir, etc. The frac ports can also be open during deployment downhole or could have a temporary plug or cap that is expelled due to the pressure of the fracturing fluid during the fracturing operation.

In some implementations, the valve assembly 10 can be configurable between a closed configuration, where the frac ports 26 are effectively blocked or closed; a fracturing configuration, where the frac ports 26 are unobstructed or open and fracturing fluid can be injected within the reservoir via the frac ports 26; and a tracing configuration, where production fluid is produced from the reservoir and flows through the tracer compartment so that tracer material is entrained and recovered for analysis. The valve assembly 10 can also move to a configuration where production fluid is received within the passage 14 but does not pass through the tracer compartment if the latter is kept enclosed and sealed. In order to operate the valve assembly 10 in these various configurations, the valve assembly 10 can include inner sleeves, or valve sleeves 30, operatively mounted within the housing 12 and displaceable between various positions.

The sleeves 30 can be provided with various features and/or in various configurations in order to be displaceable and to provide the different (e.g., non-identical) flow paths for fracturing and tracing. Some features and implementations of possible sleeve arrangements are described below.

Figure 6:
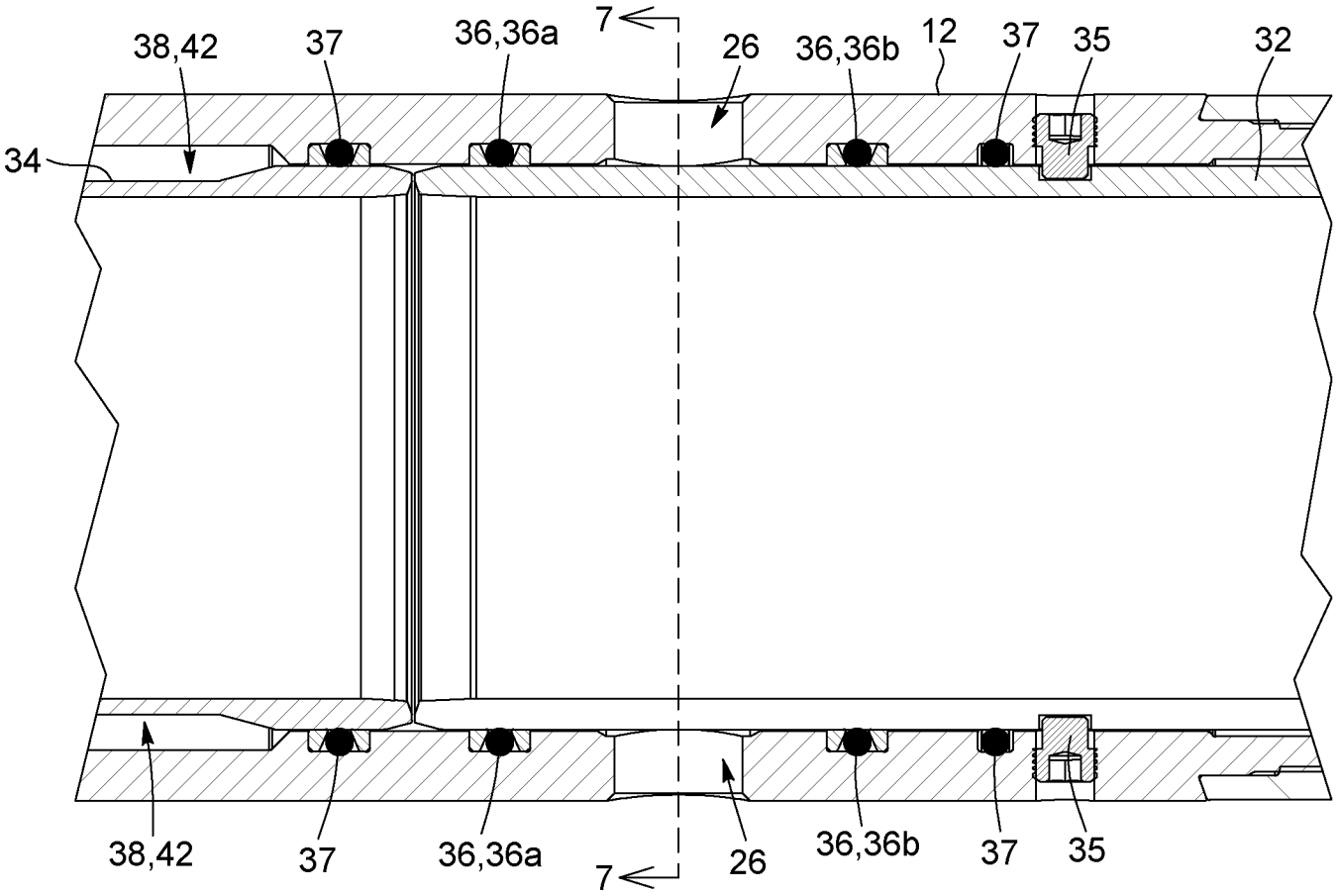
FIG. 6 is an enlarged view of a section of the valve assembly of FIG. 1A, showing the frac ports being occluded by one of the sleeves, according to an implementation.

Still referring to FIGS. 1 and 1A, and with further reference to FIG. 6, the valve sleeves 30 are operatively mounted within the housing 12 for selectively closing and opening the frac ports 26. In this implementation, the valve sleeves 30 include a pair of valve sleeves slidably mounted within the housing 12 for moving axially therealong (i.e., sliding or shifting along inner surfaces of the housing within the passage 14). More particularly, the valve sleeves 30 include a bottom sleeve 32 (or downhole sleeve) mounted within a downhole portion of the housing 12, and a top sleeve 34 (or uphole sleeve) mounted within an uphole portion of the housing 12. The valve sleeves 30 can be substantially aligned with one another and both include a bore therethrough such that fluid can flow freely along the valve assembly 10 (e.g., from one sleeve to the other and through the housing). As will be described below, the valve sleeves 30 can be independently displaced with respect to one another along the passage 14 and can be arranged in various positions in order to direct fluid flow into predetermined fluid pathways of the valve assembly 10.

The valve sleeves 30 can be mounted within the housing 12 in a manner allowing the sleeves to shift from one position to another. It should be understood that the expression "shift" can refer to the displacement of the valve sleeves 30 using a shifting tool, for example, or a self-shifting mechanism provided as part of the valve assembly. As seen in FIG. 1A, the bottom sleeve 32 can be mounted in the downhole region of the housing 12 (e.g., along the bottom barrel 25) in an occluding, or closed position, where the frac ports 26 are blocked by the bottom sleeve 32. Moreover, the top sleeve 34 can be mounted in the uphole region of the housing 12 (e.g., along the top barrel 24) in a first position, or "run-in-hole position". It is appreciated that, when the bottom sleeve 32 is in the closed position, the top sleeve 34 remains in the first position. In some implementations, the top and bottom sleeves 32, 34 can be shaped and configured to sealingly engage one another within the housing 12 in the configuration shown in FIG. 1A. In other words, the downhole end of the top sleeve 34 can contact the uphole end of the bottom sleeve 32 and create a seal therebetween. While deploying a shifting tool can be a preferred way to shift the sleeves, in an alternative scenario the sleeves can be shifted or otherwise displaced remotely.

The valve sleeves 30 can be secured in their respective positions using any suitable method. The valve sleeves 30 can be shaped and configured to engage some inner surfaces of the corresponding housing portion. For example, the valve sleeves 30 can have one or more sections having a greater outer diameter for sealingly engaging with the housing 12, and thus maintain the sleeves in position (e.g., press-fit connection). Alternatively, or additionally, the housing 12 can have portions that extend inwardly (i.e., into the passage 14) at predetermined sections for engaging with corresponding parts of the valve sleeves 30 and further securing or stabilizing the valve sleeves 30 in position. In some implementations, the valve sleeves 30 can alternatively, or additionally, be secured in position using one or more fasteners, such as shear pins 35 extending from the housing 12 and engaging the valve sleeves 30. The shear pins 35 are configured to break in order to allow the valve sleeves 30 to be shifted between positions. In this implementation, the shear pins 35 are configured to retain the sleeves in their initial positions during the completion of the wellbore, and more specifically during cementing of the casing. In other words, the shear pins 35 are configured to retain the sleeves while the sleeves are being installed along the wellbore, and while the wiper plug cleans the interior of the wellbore, as previously described.

Figure 2:
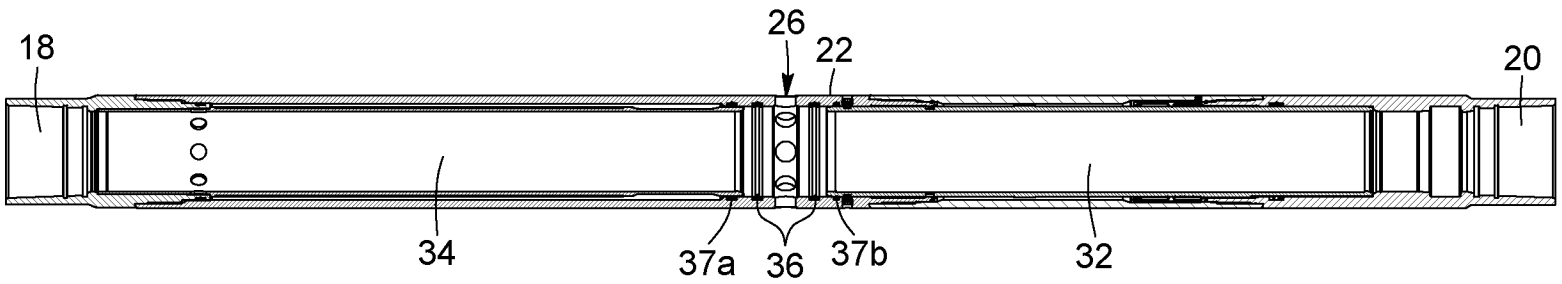
FIG. 2 is a cross-sectional view of the valve assembly of FIG. 1, showing a pair of sleeves mounted within a housing in a fracturing configuration, according to an implementation.

Referring to FIG. 2, in addition to FIGS. 1A and 6, the valve assembly 10 can further include collets, or sealing rings 36, adapted to extend between the inner surface of the housing 12 and the outer surface of at least one of the valve sleeves 30, depending on the configuration of the valve assembly 10. In this implementation, the housing 12 is provided with a pair of sealing rings 36*a*, 36*b* provided on either side of the frac ports 26 and extending inwardly from the inner surface of the housing 12 to engage the valve sleeves 30 when they are in different positions. The sealing rings 36 can be adapted to prevent, or at least reduce, axial displacement of the valve sleeves 30 within the housing 12 prior to shifting the sleeves using the shifting tool. The sealing rings 36 can further be adapted to provide fluid-sealed engagement between the housing 12 and the valve sleeve 30 to prevent fluid from flowing between the rings 36 and the sleeve 30 in certain positions. It is noted that the force required to break the shear pins 35 and initially move the sleeves 30 is greater than the force required to move the sleeves 30 for simply countering the retainment of the sealing rings 36. For example, the force required to break the shear pins 35 can be approximately 20,000 psi, while the force required to move the sleeves 30 afterwards can be between 4,000 and 8,000 psi.

Figure 7:
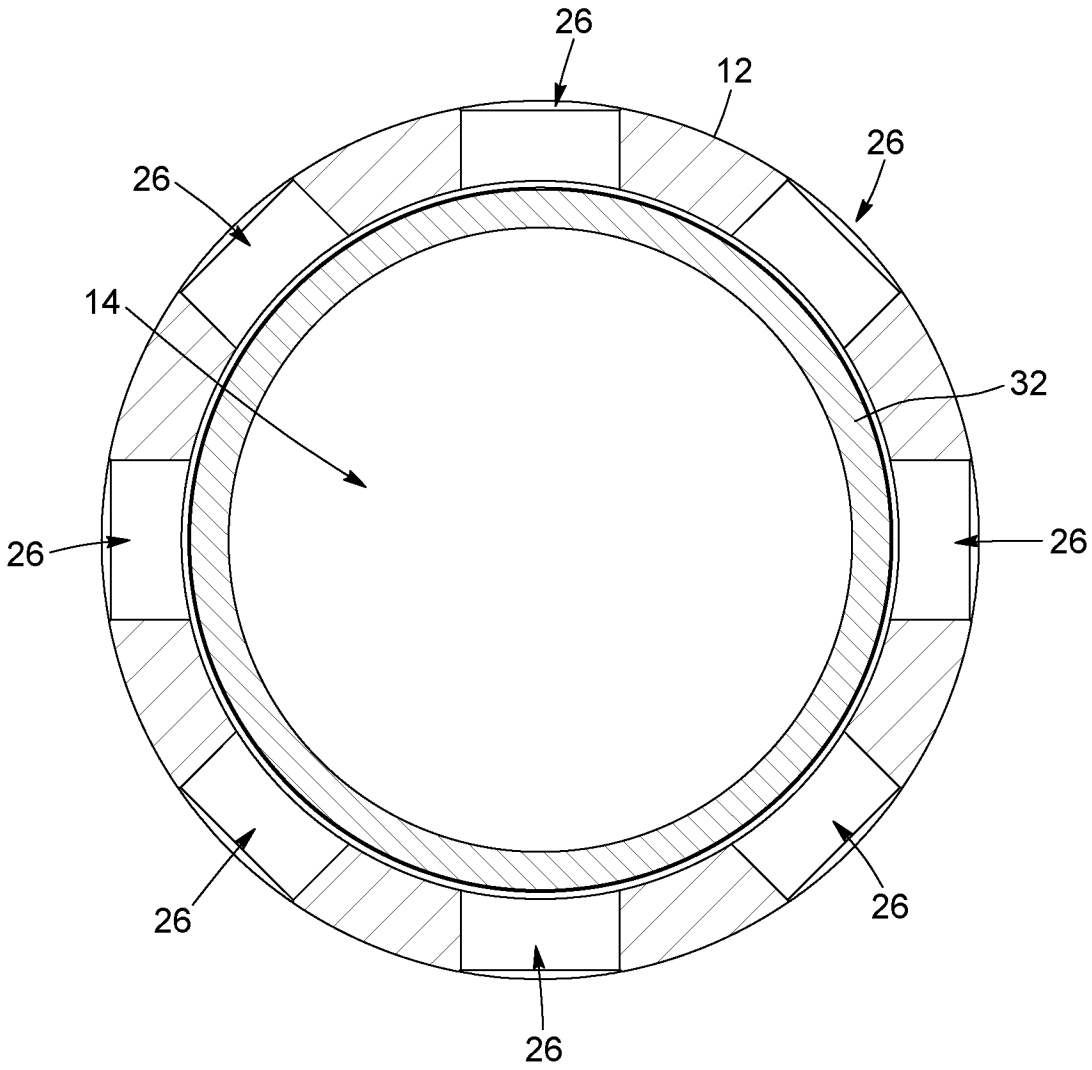
FIG. 7 is a cross-sectional view taken along line 7-7 of FIG. 6, showing a plurality of frac ports arranged about the valve assembly, according to an implementation.

As seen in FIGS. 1A, 6 and 7, when the bottom sleeve 32 is in the closed position, the uphole end of the bottom sleeve 32 covers the frac ports 26 such that fluid cannot flow therethrough. The bottom sleeve 32 further engages both sealing rings 36 such that fluid flow is prevented, or at least reduced, within interstices defined by the housing (e.g., central sub 20) and the bottom sleeve 32. In some implementations, the valve assembly 10 can include additional elements adapted to prevent, or at least reduce, movement of the sleeves and/or fluid flow into certain regions. For example, in the illustrated implementation, the valve assembly 10 includes a pair of O-rings 37 provided proximate each sealing ring 36. More specifically, a first O-ring 37*a* is provided uphole of the sealing rings 36, and a second O-ring 37*b* is provided downhole of the sealing rings 36. However, it is appreciated that other configurations are possible.

Referring more specifically to FIGS. 1A and 6, the valve assembly 10 can be run in hole in the closed configuration as part of the wellbore string, where the frac ports 26 are effectively closed or blocked. The tracer compartment is also in its enclosed configuration. In the closed configuration, at least one of the top and bottom sleeves 32, 34 is positioned within the housing 12 in a manner such that the frac ports 26 are occluded. In this implementation, the closed configuration includes positioning the bottom sleeve 32 in the closed position to prevent fluid flow between the passage 14 and the reservoir. Therefore, fluid flowing along the wellbore string flows into the valve assembly 10 at the uphole end 15, and simply flows along the central passage 14 and the internal bores of the sleeves and then out of the valve assembly at the downhole end 16.

Once the wellbore string has been positioned and installed at the desired location within the reservoir, the valve assembly 10 can be operated in the fracturing configuration in order to initiate fracturing of the reservoir. Fracturing generally includes injection of fracturing fluid into the reservoir at high pressure for fracturing the subterranean formation surrounding the valve assembly. The injection of fluid causes the rock of the formation to fracture and the fluid with proppant flows into the fractures. The proppant holds the fractures open to facilitate subsequent production.

Figure 3:
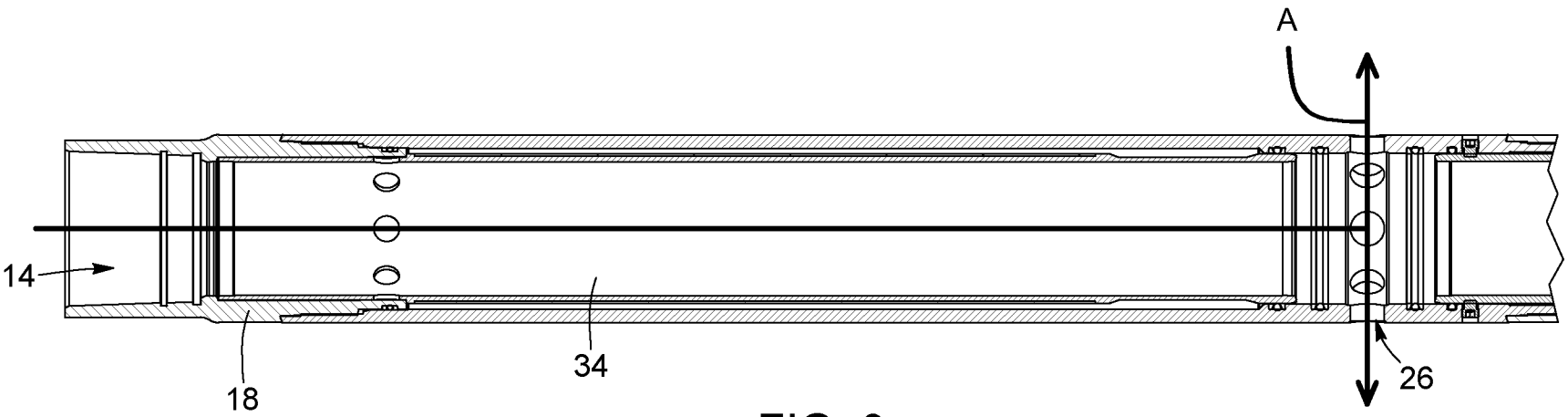
FIG. 3 is an enlarged view of an uphole section of the valve assembly of FIG. 2, showing a fracturing fluid pathway according to an implementation.
Figure 4:
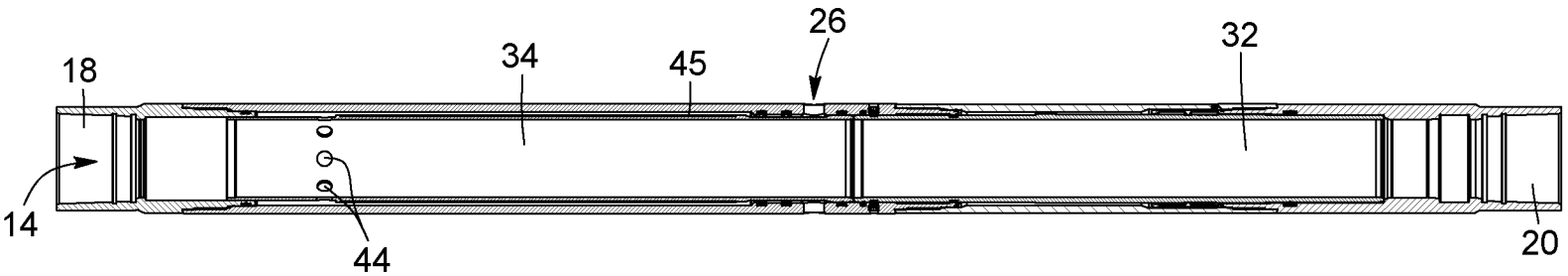
FIG. 4 is a cross-sectional view of the valve assembly of FIG. 1, showing a pair of sleeves mounted within a housing in a production configuration, according to an implementation.
Figure 8:
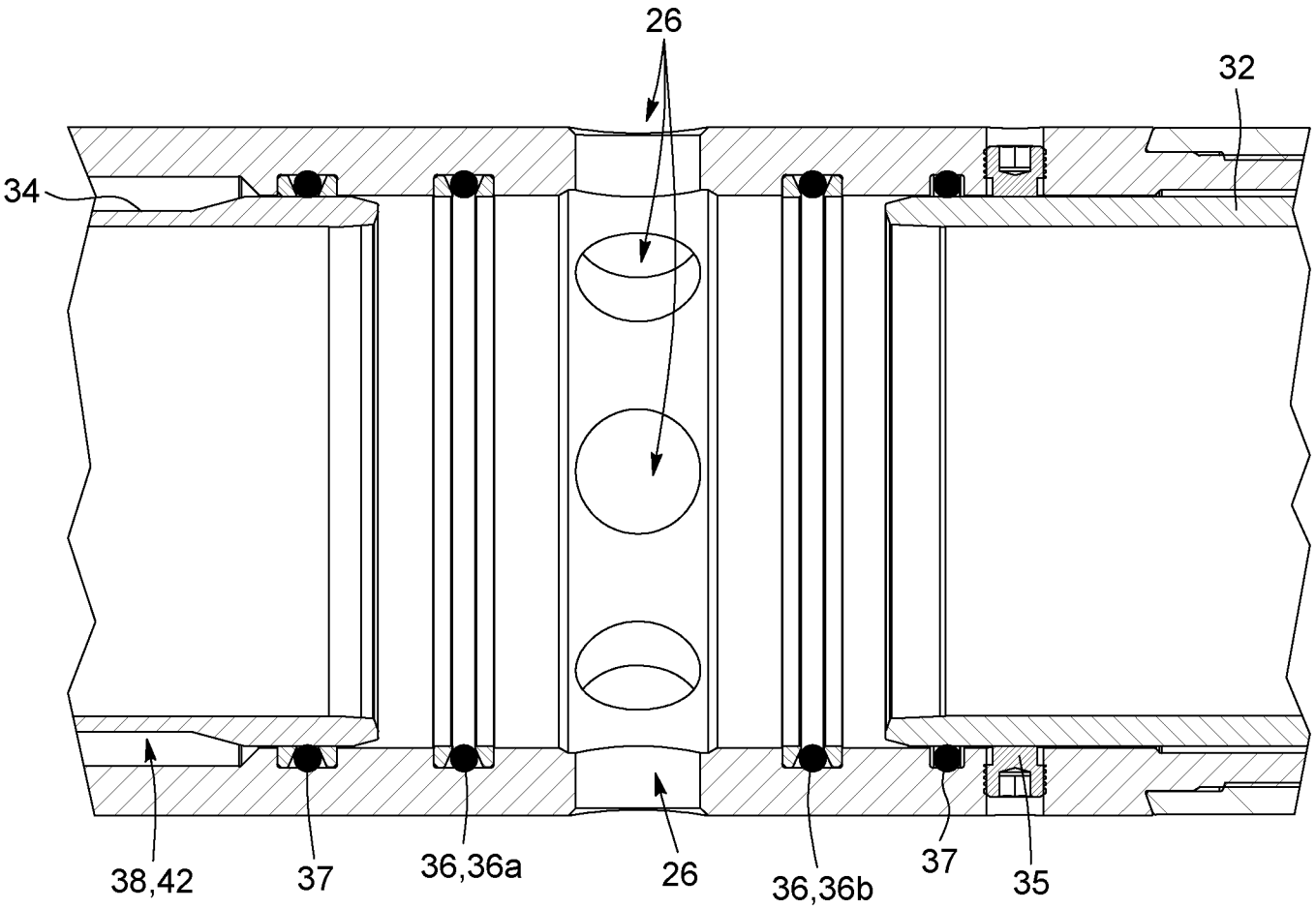
FIG. 8 an enlarged view of a section of the valve assembly of FIG. 2, showing the frac ports being open, according to an implementation.

With reference to FIGS. 2, 3 and 8, it should be understood that the fracturing fluid is injected within the reservoir from the surface via the wellbore string, and more particularly via the frac ports 26 of the valve assembly 10. It should thus be noted that, when in the fracturing configuration, the frac ports 26 are substantially unobstructed to allow fracturing fluid to be injected into the reservoir. In this implementation, in order to operate the valve assembly 10 in the fracturing configuration, the bottom sleeve 32 can be shifted to a non-occluding position, or open position, in order to open the frac ports 26. In some implementation, the bottom sleeve 32 is displaced in the downhole direction until the frac ports 26 are open, thus allowing fluid to be injected into the reservoir. However, it is appreciated that other configurations are possible. Furthermore, it should be noted that the top sleeve 34 preferably remains in the first position when operating the valve assembly 10 in the fracturing configuration in order to maintain the frac ports 26 open.

With reference to FIGS. 3 and 8, in this implementation, the valve assembly 10 defines a fracturing fluid pathway (A) along which the fracturing fluid flows to reach the frac ports 26. The fluid flowing along the fracturing fluid pathway (A) enters the passage of the housing 12 via the top sub 18, flows through the bore of the top sleeve 34 and exits the housing 12 (i.e., enters the reservoir) via the frac ports 26 of the central sub 22. However, it is appreciated that other pathways and configurations are possible for routing the fracturing fluid to the reservoir. As described above, the fracturing fluid can be forced through the frac ports 26 due to pressure build-up within the housing 12 caused by the presence of a packer, frac plug, or other obstruction (not illustrated) deployed downhole of the valve assembly 10, for example. Furthermore, once fracturing has occured, the bottom sleeve 32 can be shifted uphole, back to the closed position (as seen in FIG. 1A) to prevent back flow of the fracturing fluid from the formation and allow "healing" or equilibration of the reservoir prior to production.

In some implementations, production can be initiated using a pump coupled to the wellbore string configured to pump hydrocarbon-containing fluid uphole along the valve assembly 10 and the wellbore string for recovery thereof at surface. Production can be enabled by a downhole pump, a surface pump or artificial lift, as the case may be. It should be understood that production fluid can be recovered when the valve assembly 10 is in the so-called "fracturing configuration", whereby fluid is pumped through the frac ports into the housing 12 and follows the fracturing fluid pathway (A) in the opposite direction (i.e., uphole towards the surface). In some operations, the valve assembly is indeed operated in this manner at least for some time. This operating mode can be referred to as a non-tracing production mode, as the tracing compartment remains closed. However, as will be described below, the valve assembly 10 can be operated in a tracing and production configuration, whereby a separate fluid pathway is defined to allow production fluid to flow from the reservoir to the wellbore string through the tracer compartment, and ultimately to surface. It is noted that all of the production fluid being recovered via a particular valve assembly while in the tracing and production configuration can be routed to flow through the tracer compartment.

Figure 5:
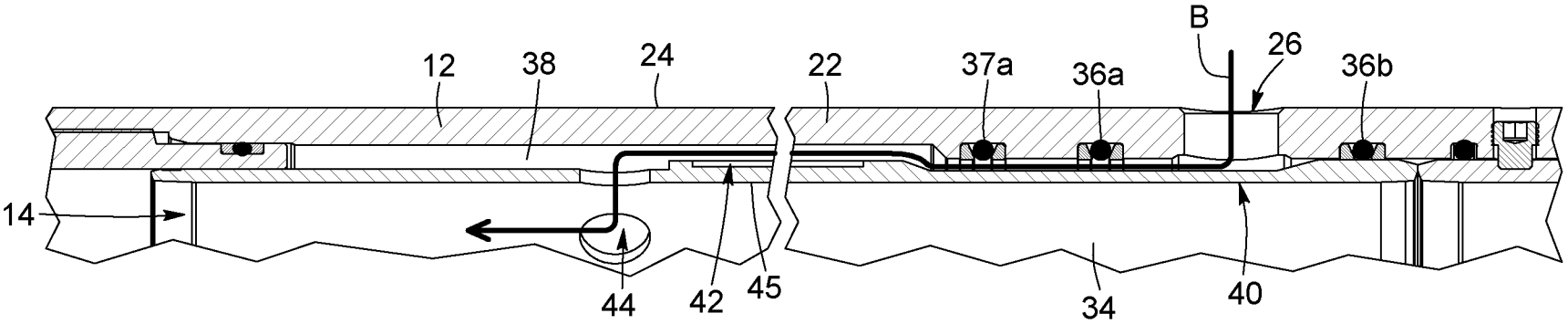
FIG. 5 is an enlarged and partly sectioned view of the valve assembly of FIG. 4, showing a production fluid pathway according to an implementation.
Figure 9:
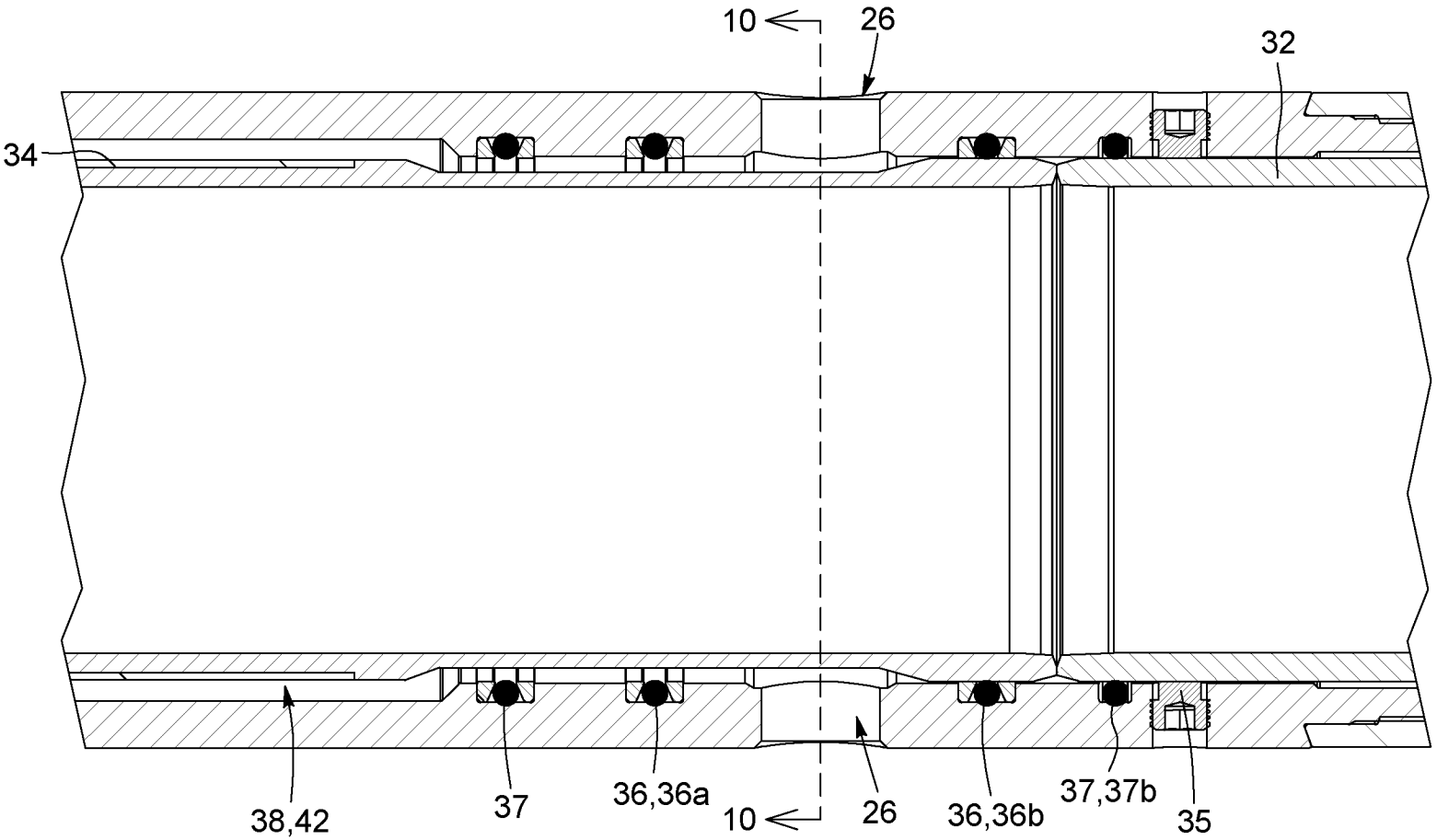
FIG. 9 is an enlarged view of a section of the valve assembly of FIG. 4, showing the frac ports being in fluid communication with an annulus, according to an implementation.

Referring to FIGS. 4, 5, 9 and 10, the tracing and production configuration allows production of water or hydrocarbon-containing fluid via the wellbore string for recovery thereof at surface. More specifically, the production configuration defines a production fluid pathway (B) along which the production fluid flows to reach the passage 14 of the valve assembly 10. As seen in FIGS. 5 and 9, the top sleeve 34 can be disposed within the housing 12 in a manner defining an annulus 38 between at least a section of the top sleeve 34 and the housing 12, and more particularly between the outer surface of the top sleeve 34 and the inner surface of the central sub 22 and top barrel 24. In some implementations, the top sleeve 34 and the housing 12 are substantially concentric and a relatively constant flow area is defined through the annulus 38. As such, the amount of fluid flowing past any given point within the annulus 38 is known and can be used to determine flow rates, for example. However, it is appreciated that other configurations are possible, such as having an annulus with a varying flow area along the top sleeve 34, for example, or defining the second fluid pathway in other ways. In the illustrated implementation, the annulus 38 defines a notable portion of the production fluid pathway (B) and is configured to allow fluid flowing from the reservoir to reach the passage 14 during production.

In some implementations, the production configuration is achieved by shifting the top sleeve 34 downhole to a tracing position such that the downhole end thereof is positioned facing the frac ports 26. It is noted that positioning the top sleeve 34 in the tracing position can push the bottom sleeve 32 to the open position simultaneously. Furthermore, in this implementation, shifting the top sleeve 34 to the tracing position establishes fluid communication between the reservoir and the annulus 38 via the frac ports 26, thereby opening the tracer compartment to fluid flow. However, it is appreciated that other configurations are possible for establishing fluid communication between the reservoir and the annulus 38. For example, the housing 12 can be provided with a second set of ports configured to be open upon moving the valve assembly 10 to the production configuration so that those ports communicate with the reservoir and the annulus.

As seen in FIG. 5, fluids flowing along the production fluid pathway (B) enter the housing 12 through the frac ports 26, flow along the annulus 38 and then enter the central passage 14 at an uphole end of the top sleeve 34. However, it is appreciated that other configurations are possible for establishing fluid communication between the reservoir and the annulus 38 and/or the opened tracer compartment. For example, the housing 12 can be provided with a second set of ports configured to be opened upon configuring the valve assembly 10 in the production configuration. The tracer compartment can also be defined as an annular volume in between the top sleeve and the housing, or as a section of the annulus, or by another volume. The top sleeve 34 can include an inlet portion 40 proximate the downhole end having a reduced diameter. The inlet portion 40 is illustratively positioned opposite the frac ports 26 to facilitate the inflow of fluid within the annulus 38 during production. Therefore, it is appreciated that, in some implementations, production fluid can enter the housing 12 through the frac ports 26 and flow into the annulus 38 via the inlet portion 40 provided at the downhole end of the top sleeve 34. The production fluid then flows along the annulus 38 towards the uphole end and into the passage 14.

In this implementation, the annulus 38 includes a tracer compartment 42 provided with tracer material configured to be recovered by fluid flowing through the annulus 38, and thus through the tracer compartment 42 in an open position. It should be noted that, in this implementation, the tracer compartment 42 is fluidly sealed from the rest of the valve assembly 10 prior to shifting the top sleeve 34 to the tracing position. Therefore, tracer material remains within the annulus 38 until the valve assembly 10 is operated in the production configuration (which can also be referred to as the tracing configuration). More specifically, the top sleeve 34 can be shaped and configured to create a seal with the housing 12 at one or both ends thereof when in the first position, thereby isolating the tracer compartment 42 within the annulus 38. For example, the top sleeve 34 can have a greater outer diameter at opposite ends thereof for engaging the housing 12 and thus maintain the sleeve sealed and in position. Alternatively, or additionally, the housing 12 can have portions that extend inwardly (i.e., into the passage 14) at predetermined sections for engaging the top sleeve 34 and further securing the top sleeve 34 in position. It is also noted that other methods of sealing the tracer compartment 42 are possible, such as using a blow-out disk (or rupture disk), or via the use of grease to occlude fluid passage, for example. Such devices could be incorporated in various ways into the assembly.

In some implementations, at least one of the housing 12 and top sleeve 34 can be shaped and configured to provide predetermined fluid dynamic conditions (e.g., having a known and/or constant flow area, surface area and/or flow volume) within the annulus 38. For example, the housing and/or top sleeve can include flow straighteners (not shown) configured to promote axial flow of fluids throughout the annulus 38. The flow straighteners can include a plurality of substantially parallel plates extending within and along the annulus 38 configured to eliminate, or at least reduce, radial movement of fluid. In addition, the flow straighteners can be adapted to favour or cause laminar flow throughout the annulus 38 such that the flow rate through the annulus can be controlled to have a laminar flow regime. Therefore, the flow rate along the tracer compartment 42, combined with the amount of tracer material recovered by the production fluid, can also be controlled, or at least be more predictable. It is noted that other methods of providing predetermined fluid dynamic conditions in order to obtain a consistent and/or predictable flow throughout the annulus 38 are possible.

As seen in FIGS. 5 and 9, the top sleeve can engage the housing 12, and more specifically engage the sealing ring **36*b* downhole of the frac ports 26, but does not engage the sealing ring 36*a* uphole of the frac ports, which provides a fluid pathway past this uphole sealing ring. As such, fluid flowing through the frac ports 26 is substantially confined to flow along the annulus 38. In other words, the entire volume of production fluid flows into the housing, along the annulus 38, through the tracer compartment 42 and past the tracer material contained therein. The uphole end of the top sleeve 34 can be similarly shaped and configured to engage the housing 12 to further hold the top sleeve in position. In this implementation, the uphole end of the top sleeve 34 can be connected to the housing via a press-fit connection, although it is appreciated that other configurations are possible, such as using fasteners, for example. Alternatively, the uphole end of the top sleeve 34 can be free of contact from the housing 12 to allow fluid from within the annulus 38 to flow into the central passage 14 by simply flowing past the uphole edge of the top sleeve 34**.

In the illustrated implementation, the top sleeve 34 can be provided with production ports 44 for allowing fluid to flow from the annulus 38 to the central passage 14 when both ends of the top sleeve are sealingly engaged with the housing 12. The production ports 44 extend through a wall thickness of the top sleeve 34 and are configured to establish fluid communication between the annulus 38 and the central passage 14. It should be understood that the production ports 44 allow fluid flow therethrough when the top sleeve 34 is in the tracing position, and that the production ports 44 are closed when the top sleeve 34 is in the first position. For example, when the top sleeve 34 is in the first position (e.g., seen in FIGS. 1A and 2), part of the housing 12 engages the top sleeve 34 so as to cover the production ports 44. More particularly, the top sub 18 engages the top sleeve 34 in order to hold it in the first position, and simultaneously occludes the production ports 42. The portion of the housing 12 that occludes the production ports can be designed to have a smaller internal diameter than the internal diameter along the annulus 18, thereby blocking the production ports 42 when the top sleeve 34 is in the first position. Alternatively, or additionally, the top sleeve 34 can have a larger outer diameter proximate the production ports 42 to engage the housing.

In some implementations, the top sleeve 34 can be repeatedly shifted between the first position and the tracing position. Therefore, tracer material can be released into the production fluid by shifting the top sleeve 34 to the tracing position, and then the tracer material can be re-sealed within the tracer compartment 42 for future use by shifting the top sleeve 34 back in the first position, thus extending the lifespan of the tracer material. As mentioned above, production fluid can still be produced through the frac ports 26 and the first fluid pathway when the top sleeve 34 is in the first position, although tracer material will not be contacted in that mode. It is also noted that after fracturing, the valve assembly can initially be operated so that the production fluid flows via the first fluid pathway (i.e., in an uphole direction) and therefore does not absorb or entrain any tracer material initially, and then at some future stage the top sleeve 34 can be displaced to change the fluid pathway for the production fluid to the second fluid pathway, thereby initiating tracing operations. As mentioned above, the top sleeve 34 can be shifted back into the first position in order to operate the valve assembly in the non-tracing production configuration, thus re-isolating the tracer compartment 42, and thus the tracer material, within the annulus 38.

Figure 10:
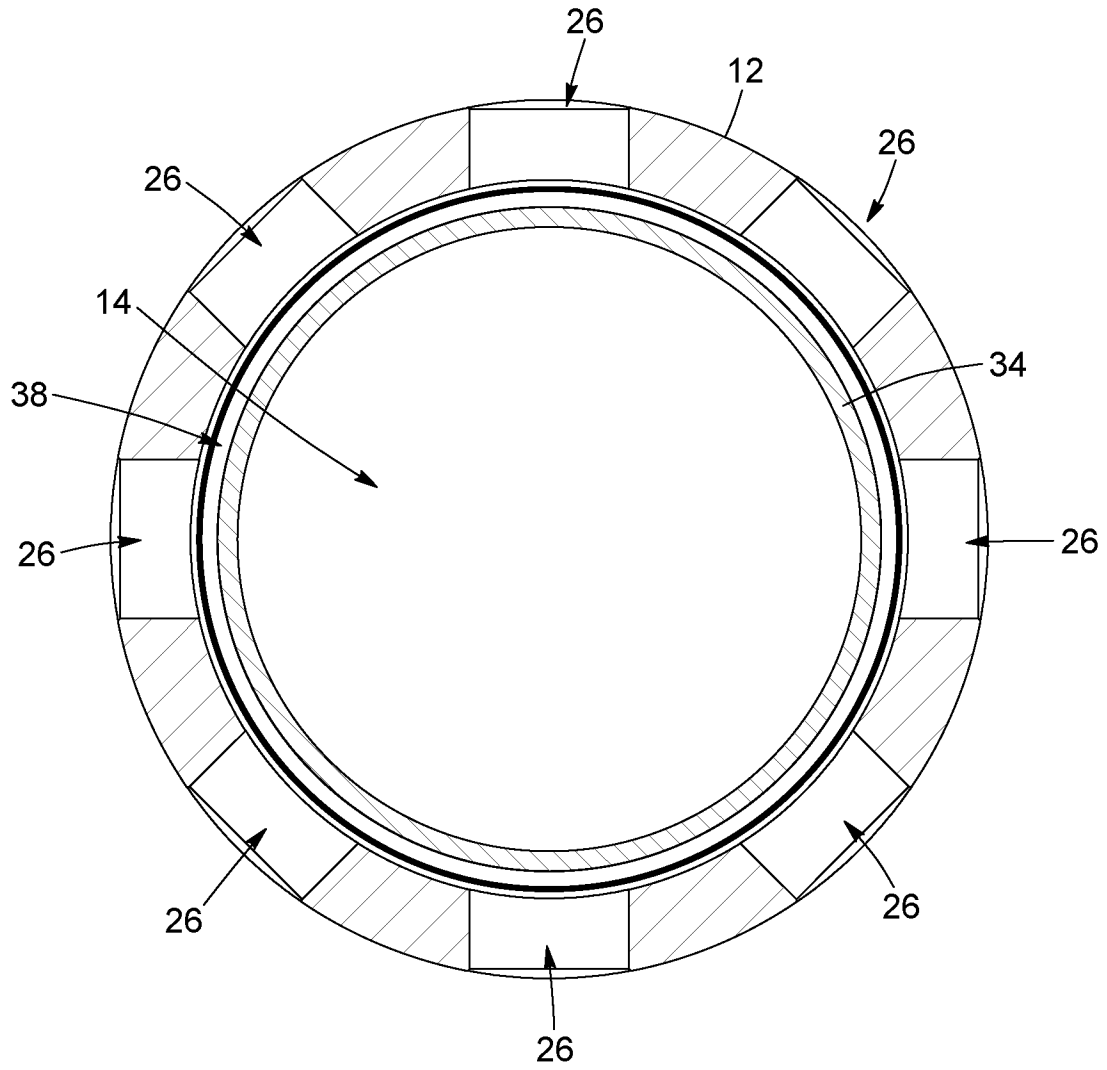
FIG. 10 is a cross-sectional view taken along line 10-10 of FIG. 9, showing a plurality of frac ports arranged about the valve assembly and allowing fluid communication with the annulus, according to an implementation.

Referring back to FIGS. 4 and 5, with further reference to FIGS. 9 and 10, the tracer compartment 42 is disposed within the annulus 38 between the frac ports 26 and the production ports 42. Therefore, production fluid flowing along the production fluid pathway (B) flows through the tracer compartment 42 and simultaneously recovers tracer material. In some implementations, the housing 12 and/or top sleeve 34 can be shaped and configured to provide a certain size of the annulus 38 (e.g., having recessed surfaces of the sleeve or corresponding barrel of the housing to provide a larger volume compared to flat surfaces). The sizing of the annulus can be done in order to provide pre-determined surface area, length, cross-sectional flow area and/or volume in order to facilitate quantification analyses, since known fluid dynamics and tracer contact areas within the compartment can be correlated to oil or water flow rates.

It should be understood that, as used herein, the expression "quantification" can refer to the correlation or estimation of the detected tracer to the amount of oil and/or water produced from that stage and has therefore contacted and entrained the tracer. For instance, the amount (e.g., weight or concentration) of the tracer can be measured at the surface, and this measurement can be used to determine an approximate mass or volume of oil and/or water that was produced via a certain stage or stages. When different tracers are used in respective valve assemblies that are located at respective stages along the well, the surface measurements of the tracers can be used to quantify production features of each stage, which can be quite useful to assess the performance of the different stages. Quantifying each stage of the wellbore can therefore involve determining flow rates of certain fluids (e.g., oil and/or water) along the wellbore. As such, it is possible to determine if a particular stage is producing fluid, and if it is, which fluid it is producing (e.g., oil or water) and in what amount or relative proportion to other fluids produced from that stage.

Furthermore, the stages can be compared or ranked according to the amount of fluid being produced, which can assist in determining subsequent operations over the lifetime of the well.

Quantification analyses can be facilitated by a number of features related to the construction of the valve assembly and other factors. For example, the valve assembly can be configured such that the tracer compartment has predetermined geometrical characteristics when the second flow pathway is open and receiving production fluid. The tracer compartment can have one or more features that facilitate quantification, such as a predetermined volume; a predetermined surface area over which tracer is present and in contact with the production fluid; a predetermined shape and size in which the production fluid would have known fluid flow properties (e.g., flow regime); a tracer material that is provided in order to have predetermined desorption or release rates in response to certain conditions (e.g., fluid flow, temperature, pressure, fluid composition); a predetermined tracer concentration, mass or availability within the tracer compartment; a configuration that forces all of the production fluid flowing through the valve assembly from the well and into the well to pass through the tracer compartment; and so on. For instance, by having predetermined tracer release rates and tracer compartment geometries, correlations can be developed such that the measured tracer concentration at surface can be used to determine the flow rate of fluids from that particular stage.

In another example, the tracer compartment can be provided as an annular compartment with a predetermined volume and internal surface area defined by smooth walls, where an oil-soluble tracer is provided over a predetermined surface area and has a generally known release rate within certain operating envelopes of production fluid flow and composition. The oil-soluble tracer would then be released into the oil phase of the production fluid depending on the concentration and flow rate of the production fluid. At surface, the combined production fluid could be analysed to determine the concentration of that particular oil-soluble tracer, and this concentration could be used to determine the quantity of oil being produced by that particular stage of the well. The correlations that could be used for quantifying certain properties of the stages (e.g., water production, oil production, overall fluid production, etc.), could be developed in various ways, such as building calibration models based on laboratory tests. In some implementations, the tracer compartment has a geometry that facilitates modelling; for example, when the tracer compartment is substantially annular and/or defined by opposed walls that are parallel to each other, then fluid dynamics and modelling related to flow through parallel plates or annuli can be used.

The tracer compartment 42 can also be sized size to accommodate pre-determined or desired quantities of tracer material. It can be desirable to provide large amounts of tracer material in the tracer compartment in order to facilitate tracing over a long period of time. The tracer material can also be provided with slow and/or known desorption or release properties to facilitate quantification analyses. In some implementations, the tracer material is selected and provided to have a slow release rate into the production fluid, which results in low concentrations of tracer being present in the production fluid, but the tracer fluid is also selected to have high detectability at low concentrations (e.g., in the parts per billion or trillion range). An example tracer material with highly sensitive detectability is nucleic acid-based tracers that can be amplified in a sample. In some implementations, the tracer compartment 42 can include an annular region that forms most of its volume.

The tracer material can be provided in various forms within the tracer compartment and the given method for providing the tracer into the production fluid may depend at least in part on the type and form of tracer material. The tracer can have various properties and chemical structures. For instance, the tracer material can include an oil-soluble tracer or a water-soluble tracer, and can be based on various chemistries. The tracer chemical itself can be provided in various ways, including directly by itself, associated on or in particles that are provided in the tracer compartment, associated with a solid matrix that is provided in the tracer compartment (e.g., coated onto its surfaces), as part of a solution or dispersion that is provided in the tracer compartment, and so on.

The delivery of tracer material into the production fluid can be done in various ways. For instance, the tracer compartment can be provided as part of the production flowpath, as per the main implementations described herein and shown in FIGS. 1 to 10. The tracer compartment can for instance be defined within an annulus in between two seals and in between the sleeve and the housing when in the fracturing position, and then the tracer compartment is opened up and becomes part of the production fluid flow path in the tracing position.

Alternatively, the tracer material can be delivered into the production fluid flowpath in other ways. For example, the tracer material can be housed in a separate compartment configured so that it can become in fluid communication with the production flowpath so that tracer flows into the production fluid. In such scenarios, the tracer can be delivered into the annulus 38, into part of the anulus, or into another conduit or flowpath that could be located or constructed within the annuls. Such embodiments are particularly applicable when the tracer material is a liquid or is provided in a liquid carrier fluid. The tracer material delivered into the production fluid from the separate compartment can be metered based on the flow of production fluid flowing through the sleeves of the valve assembly. For example, the annulus 38 could be be provided with a tracer compartment that is separate from the production fluid flowpath, while allowing fluid communication between the tracer compartment and the production fluid flowpath, and arranged to enable metering the tracer material being released from the tracer compartment based on flow rate(s) or volume of fluids passing through the production fluid flowpath. In some implementations, the production fluid flowpath could be similar to the one illustrated in FIGS. 1 to 10, and thus be generally defined by the annulus between the sleeve and the housing with the inlet being the frac port in the housing and the outlet being a port at an uphold end of the sleeve.

Figure 11:
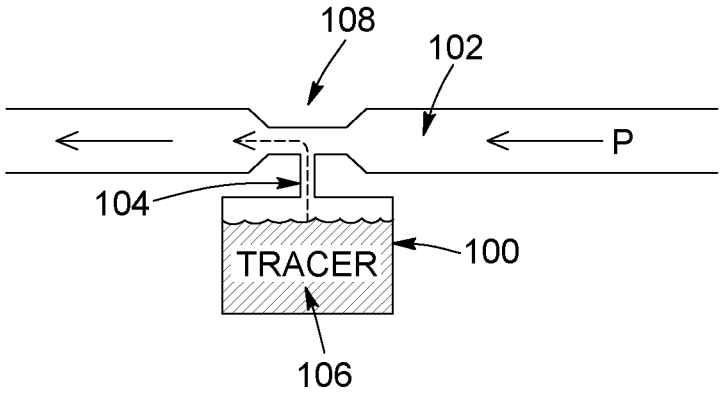
FIG. 11 is a schematic of a tracer compartment and venturi type delivery system.
Figure 12:
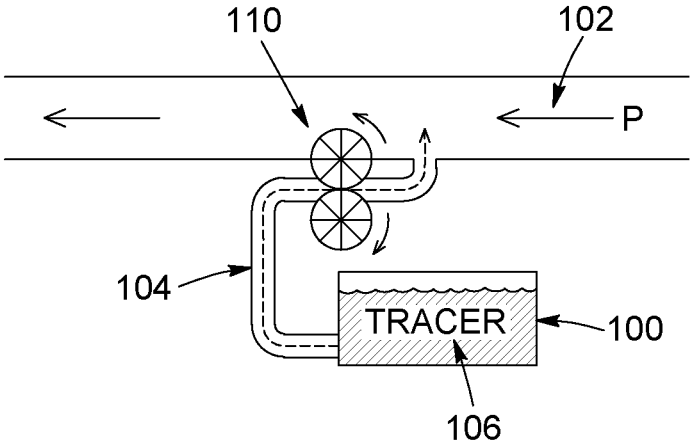
FIG. 12 is a schematic of a tracer compartment and a gear pump type delivery system.

Referring now to FIGS. 11 and 12, the separate tracer compartment 100 can be fluidly connected to the production flowpath 102 via a tracer feed conduit 104. The tracer can be provided as a tracer liquid 106 and the driving force for forcing the tracer liquid 106 to flow from the separate tracer compartment 100 into the production flowpath 102 can be provided by a venturi system 108 (see FIG. 11) or a gear pump or paddle wheel system 110 (see FIG. 12). In both of these embodiments, the flow of the production fluid influences the flow rate of the tracer liquid 106 that enters the production fluid. By coupling the production flow rate with the tracer liquid flow rate, certain quantification techniques (e.g., determining production flow rate from that stage) can be facilitated. In such cases, higher production flow rate causes higher tracer flow rates into the production fluid, and therefore higher tracer concentrations measured at surface can be correlated to higher production flow rates at the given stage.

Figure 14:
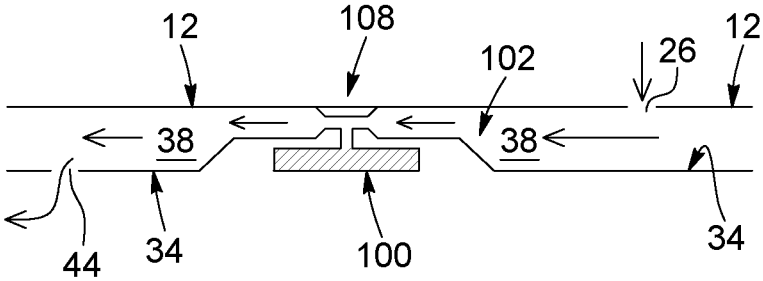
FIG. 14 is a schematic of part of a valve assembly that shows a production fluid pathway defined in an annulus between a sleeve and a housing and a venturi system for delivering tracer into the production fluid.

The venturi system or the gear pump system can be integrated into the valve assembly in various ways. Turning to FIG. 14, one example is shown where the venturi system 108 is integrated into the annulus 38 defined between the housing 12 and the top sleeve 34.

It is also noted that configurations other than the venturi system and the gear pump system are possible for metering the release of tracer within the production fluid flowing through the valve assembly.

Figure 13:
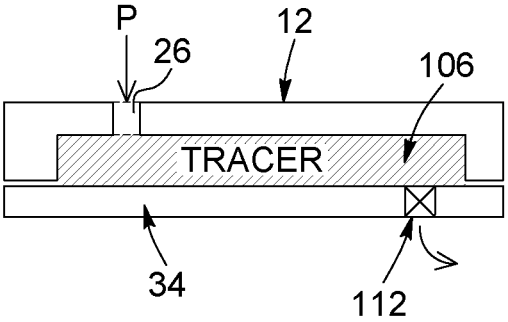
FIG. 13 is a schematic of a tracer compartment that includes a burst disc or check vale for releasing the tracer in response to fluid pressure.

Turning now to FIG. 13, the tracer compartment can be provided in the annulus and the production port can be provided with a pressure-responsive member 112 that opens in response to elevated pressure. The pressure-responsive member 112 can include a burst disc or check valve, for example. When the production fluid exerts pressure on the tracer liquid 106, the elevated pressure causes the pressure-responsive member 112 to open, thus allowing a bolus of the tracer to be released. The burst disc would rupture in order to allow the tracer and production fluid to flow, while the check valve would open above a certain pressure level.

The tracer material can be one or more of the following:

Water/Oil Tracers

Esters, alcohols, carboxylic acids, benzene sulfonic acids, halogenated benzene, sulfonic acids, polyaromatic sulfonates, halogenated benzoic acids, halogenated benzoic aldehyde, halogenated benzoic alkylaldeydes, fluorophores, thiocyanates, nitrates, iodides, bromides, alcohols, kentones, metal cyanides (e.g., $Co(CN)_6^{3-}$; $Ni(CN)_4^{2-}$; $Ag(CN)_2^-$; $Au(CN)_2^-$, $Au(CN)_4^-$)), magnetic nanoparticles, any of the above compounds tagged with 13C atoms, any of the above compounds tagged with deuterium, heavy water ($D_2O$); tritiated water, alkanes, alkenes, cycloalkanes, etc., optionally tagged with 13C atoms; alkanes, alkenes, cycloalkanes, etc., optionally tagged with deuterium; amides, amines, optionally tagged with 15N; metal cyanides, metal cyanides tagged with 15N; nitrate- and nitrite-containing compounds optionally tagged with 15N; iodine-containing compounds optionally tagged with 1311 or 1251; bromine-containing compounds tagged with 82Br; cobalt-containing compounds optionally tagged with 58C or 57C; sodium-containing compounds optionally tagged with 22Na or 24Na; iron-containing compounds tagged with 59Fe; sulfur-containing compounds tagged with 34S. The water or oil tracers can also be tagged with 14C or 3H.

Gas Tracers

Perfluorocarbons, tritiated methane, tritiated ethane; 85Kr, radioactive species, tritiated water, 35S, 14C tagged SCN-, 57Co, 60Co, 46Sc, 124Sb, 192Ir, 14C tagged halogenated benzoic acids, metal cyanides (e.g., $Co(CN)_6^{3-}$; $Ni(CN)_4^{2-}$; $Ag(CN)_2^-$; $Au(CN)_2^-$, $Au(CN)_4^-$)), with the metal ion radiolabeled: 56Co, 57Co, 58Co, 63Ni, 195Au, 110Ag or with 14C.

Other tracer compounds could also be envisioned. For example, one or more oligonucleotides could be deployed in the tracer compartment. RNA or DNA molecules could be used. These types of tracers have a benefit of having low detection levels and therefore smaller volumes of the tracer is required. This low level detection feature can also be beneficial when used in valve assemblies that have a tracer compartment that is relatively limited in volume (e.g., when it is defined in the annulus between the sleeve and the housing, as in the figures), as lower tracer volumes results in greater free volume for fluid flow through the second fluid flow path. The oligonucleotides can be small fragments having up to 40, 50, 60, 70, 80, 90 or 100 residues, for example, or can be larger molecules. The sequences of the oligonucleotides can be provided such that different ones are provided for each valve assembly of each stage of each wellbore, although other configurations are possible.

Turning back to the figures, preferably, the tracer compartment 42 is defined between the inner surface of the housing 12 and the outer surface of the top sleeve 34, as illustrated. However, the tracer compartment could also be defined by other structures that are disposed within the annulus, if desired. The tracer compartment is preferably defined as an annular volume with substantially constant area over its length, as illustrated, although it could be designed to have various other configurations and shapes.

In some implementations, the tracer material can be soluble in at least one component of the production fluid (e.g., oil or water or gas), such that fluid flow during production recovers tracer material from the tracer compartment 42. More specifically, the tracer material can include at least one of a water-soluble tracer material, a hydrocarbon-soluble tracer material and a gas-soluble tracer material, among others. Therefore, it should be understood that components and phases of the production fluid can be determined based on the type of tracer material recovered at surface. In some implementations, each stage of the wellbore has a valve assembly that is provided with at least one unique tracer material that is not present in any other valve assembly or stage, such that recovery and analysis of that unique tracer material can allow identification of the stage from which fluid or phase was recovered. It is appreciated that any suitable or known type of tracer material can be used, such as radioisotope tracers (e.g., deuterium), radioactive tracers, fluorescent tracers and/or chemical tracers, for example. Polynucleotide tracer materials, such as DNA-based tracers, can also be used and can be particularly suitable for lowering the required detection levels (e.g., to less than parts-per-billion or trillion levels), which can consequently reduce the amount of tracer material needed within the tracer compartment 42.

The tracer material can be provided in the form of strips, rings, or coatings comprising the tracer material 45 disposed within the tracer compartment 42. The strips 45 can be adhered to the outer surface of the top sleeve 34, the inner surface of the top barrel 24, or a combination thereof, such that fluid flowing through the tracer compartment 42 contacts the strips 45 and recovers tracer material. In some implementations, the strips 45 are disposed substantially parallel to one another about the top sleeve 34 and can be further parallel to the longitudinal axis of the top sleeve 34. Alternatively, the strips 45 can be formed as rings surrounding the top sleeve 34 or coiled about the top sleeve 34 which can control (e.g., restrict) fluid flow through the tracer compartment 42 while increasing the amount of tracer material installed within the tracer compartment 42. The strips can have a thickness that is substantially the same as the annulus, thereby filling the annulus along their length. Alternatively, the strips could have a thickness that is less than that of the annulus in order to provide a space in between the top surface of the strips and the opposing surface (e.g., the inner surface of the housing).

The strips 45 of tracer material can also be provided within recesses formed in the walls of the tracer compartment 42 (e.g., in the top sleeve 34 or in the top barrel 24 of the housing) such that the strips 45 are at least partially embedded therein. As such, the walls, in combination with the embedded strips, can have a substantially flat surface throughout the tracer compartment 42 in order to facilitate fluid flow therethrough. In other words, the top surface of the strips of tracer material can be substantially co-planar, or contiguous, with the outer surface of the top sleeve 34. In some implementations, at least some of the strips 45 can have a thickness extending within the flow area of the annulus 38 in order to act as flow straighteners, for example, although other configurations are possible.

In some implementations, each strip 45 or subgroup of strips can include a different type of tracer material. For example, some strips can include water-soluble tracer material, and other strips can include hydrocarbon-soluble tracer material. Moreover, the plurality of strips 45 can be disposed about the top sleeve 34 in order to alternate between the different types of tracer materials. Alternatively, the top half of the tracer compartment 42 (e.g., circumferentially) can be provided with hydrocarbon-soluble tracer material, and the bottom half can be provided with water-soluble tracer material, or vice-versa. It should be noted that the strips 45 of tracer material can be disposed within the tracer compartment 42 in any suitable manner in order to allow the production fluid to recover tracer material during production.

Alternatively, or additionally, the tracer material can include a substantially uniform coating of tracer material provided within the tracer compartment 42 (e.g., within the annulus 38). The tracer coating can be provided to have a substantially uniform thickness and composition over its application area, for example. This can facilitate production fluid to have a generally constant contact area with the tracer material to promote quantifiable recovery of the tracer. The coating can have a thickness between about 0.02 inches and about 0.12 inches, although other thicknesses are possible. The coating can be applied conformally over the applied surface to provide a constant thickness and a particular surface area that can be defined as substantially cylindrical, for example. It should thus be understood that the thickness of the coating of tracer material can gradually decrease as tracer material is recovered by the production fluid, consequently reducing the cross-sectional flow area of the tracer compartment. In some embodiments, the reduction of the cross-sectional flow area is less than about 10%, although it is appreciated that other configurations are possible. The coating can be provided over a surface area within the tracer compartment that is subject to similar or constant fluid flow conditions, to further control the conditions for facilitating quantification analyses. Furthermore, in some implementations, the tracer compartment 42 can be provided with a plurality of coatings of tracer material, whereby each coating includes a different type of tracer material (e.g., hydrocarbon-soluble, water-soluble or gas-soluble, among others). In a similar fashion to the strips 45, the coatings of tracer material can be disposed side-by-side and alternate about the top sleeve 34 within the tracer compartment 42. Alternatively, the plurality of coatings can be superposed within the tracer compartment 42, although other configurations are possible.

In yet another alternative implementation, the tracer material can be provided in channels (not shown) provided along or about the top sleeve 34 and extending through the tracer compartment 42. Each channel can be provided with a unique tracer (e.g., water-soluble or oil-soluble, among others) and be selectively opened and closed. For example, each channel can include an access mechanism to allow fluid flow therethrough for controlling the amount of production fluid being produced at any given time, and for controlling the type of tracer being recovered. Alternatively, the production fluid pathway can define a path leading to a single channel at a time, and the channels can be configured to align with the production fluid pathway via rotation thereof for example. By rotating the channel-system, a given channel can be selected to align with the production fluid pathway so that production fluid flows only through that selected channel, thereby receiving only the unique tracer that is present in that channel. When a new tracer is desired, the channel-system can be rotated to align another channel with the production fluid pathway so that the new tracer is released into the production fluid. In this manner, a system that includes multiple channels can be used to rotationally "dial" the system to the desired tracer at different points in time and depending on various factors. The production fluid pathway can also be configured so that it can align with a single tracer channel at a time, and it can thus be constructed as part of the annulus, for example.

Regarding the deployment of the tracer material within the tracer compartment, various methods can be used. For example, the tracer material can be bonded to or within a carrier or matrix, which can in turn be disposed within the tracer compartment 42. In some implementations, the matrix can be a polymer matrix, which can be formulated and provided so that the production fluid flowing along the production fluid pathway effectively weakens the bonds between the tracer material and the matrix in order to cause the release of molecules of tracer material for recovery to surface. The released molecules of tracer material can then be analyzed to determine certain variables, such as the component of the production fluid (e.g., determine if the fluid contains hydrocarbons and/or water) and/or flow rates of each fluid component. The matrix can be made of one or more polymeric materials, such as polyurethane, epoxy or polystyrene, for example. The polymer matrix and its association with the tracer material can be provided such that the tracer material is released at a generally known rate under certain fluid conditions. In some implementations, the tracer release rate can be determined experimentally, and calibration curves can be developed in advance of deployment, to facilitate analyses during operation. The tracer material can be associated with or supported by the matrix in various ways, including covalent bonds, adsorption, entrapment, etc. The polymer matrix can be designed such that it retains its general structure during release of the tracer material, or such that it dissolves or disintegrates in order to release the tracer material.

In another possible implementation, the tracer material could be entrapped within carrier chambers that are located in the tracer compartment, where the carrier chambers are made of a material that dissolves or disintegrates at a known rate in response to certain fluid conditions (e.g., composition, flow). The carrier chambers could be provided with different disintegration properties, such that the detection of a certain tracer at surface would indicate that a certain carrier chamber has broken down and, therefore, certain fluid conditions are present at that particular stage. In this scenario, the predetermined properties of the carrier chamber material could facilitate quantification rather than predetermined properties of the particular tracer material itself.

It should thus be understood that the valve assembly 10 can be used as a diagnostic tool during production of the reservoir via the wellbore. More specifically, when a wellbore starts to produce greater amounts of water, the recovered tracer material can be analyzed to determine which stage of the wellbore is producing water, and the necessary means can be deployed to reduce the amount of water being produced. For example, the valve assembly 10 corresponding to the stage over-producing water can be moved to a closed or semi-closed or choked configuration to cease or reduce production.

Now referring to FIGS. 15 to 23, various implementations of a valve assembly 10 comprising a single valve sleeve 30 are shown. The single valve sleeve 30 can be slidably mounted within the housing 12 for moving axially therealong (i.e., sliding or shifting along inner surfaces of the housing within the passage 14). Similar to previously described implementations, the single valve sleeve is operable between a closed position, an open position and a tracing position. Moreover, the tracer compartment 42 can be defined between the housing 12 and the valve sleeve 30 provided therein. Referring more specifically to FIGS. 15 to 19, in this implementation the valve assembly 10 includes a bypassing mechanism 50 adapted to establish fluid communication between the reservoir and the tracer compartment 42 while the valve sleeve 30 is in any one of the open, closed and tracing positions. However, and as will be described further below, the bypassing mechanism 50 can be adapted to prevent fluid communication between the frac ports 26 and the tracer compartment 42 during certain operations.

In some implementations, the bypassing mechanism 50 illustratively includes a plurality of shunts 52 extending between the frac ports 26 and the tracer compartment 42, therefore establishing fluid communication therebetween. The shunts 52 can be substantially tubular, each having a shunt inlet communicating with one or more frac ports 26, a shunt outlet communicating with the tracer compartment 42, and an inner passage allowing fluid flow therethrough and extending between the frac ports 26 and the tracer compartment 42 along the outer surface of the housing 12. By positioning the shunts along the outer surface of the housing 12, the valve sleeve 30 can have a generally tubular shape with a constant cross-sectional area along its length (i.e., the inner and/or outer diameters of the valve sleeve does not vary along its length).

Figure 16:
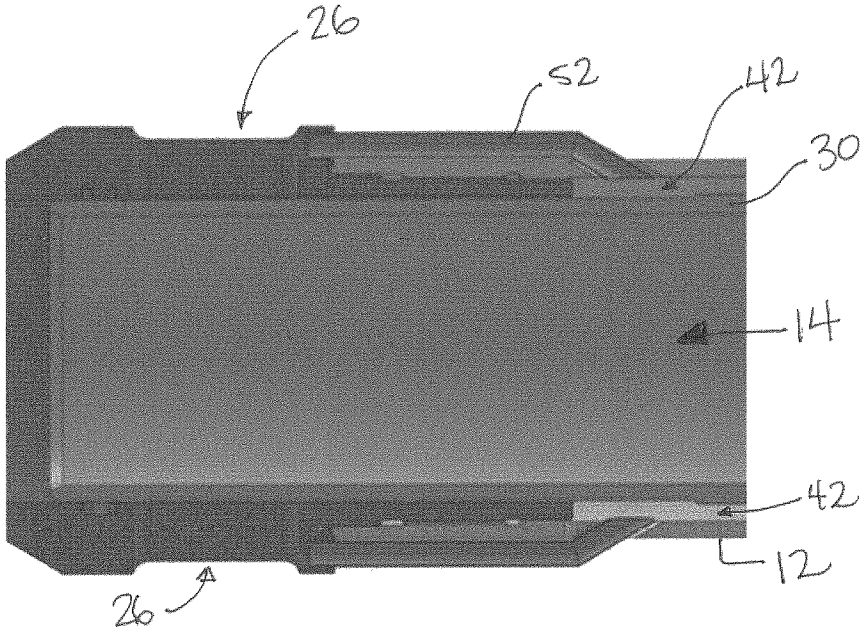
FIG. 16 is a cross-sectional view of a frac port of the single valve shown in FIG. 15, showing the valve in the closed configuration, according to an implementation.
Figure 15:
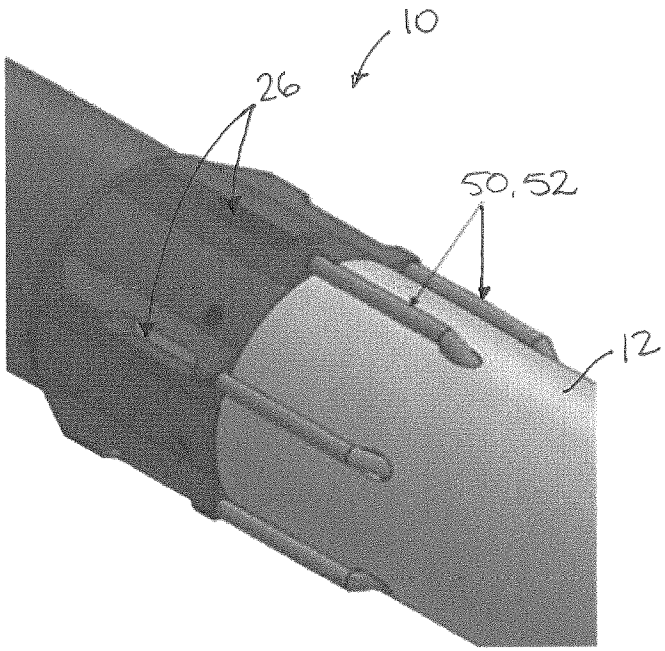
FIG. 15 is a perspective view of a section of a valve assembly comprising a single valve, according to an implementation.
Figure 17:
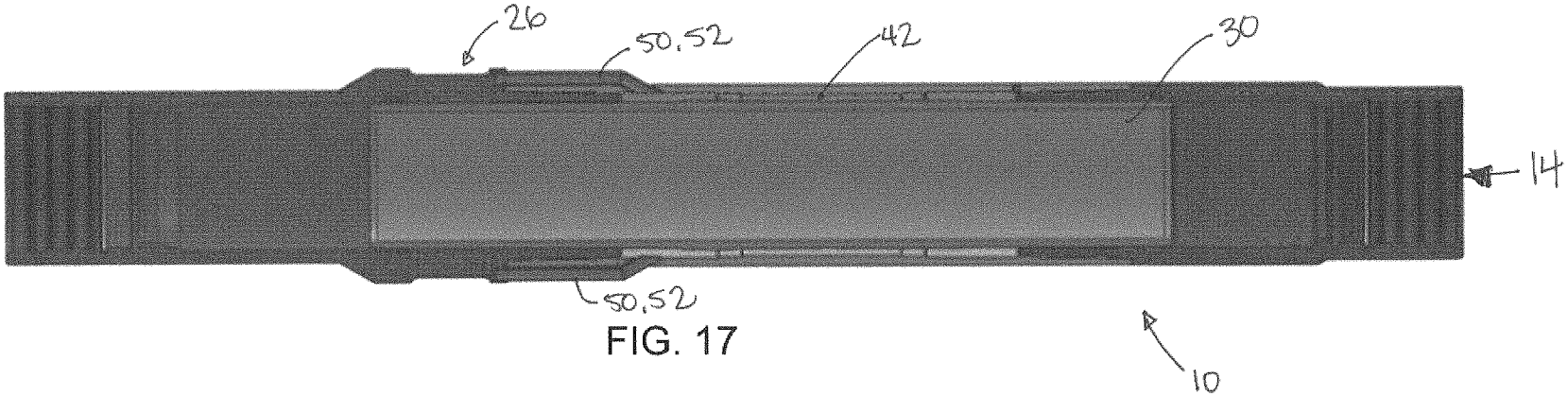
FIGS. 17 to 19 are cross-sectional views of a section of a valve assembly comprising a single valve.

As seen in FIGS. 16 and 17, the valve sleeve is in the closed position, with the body of the valve sleeve occluding the frac ports 26. It should thus be understood that, when in the closed position, production of fluids from the reservoir via the frac ports 26 and injection of fluids into the reservoir via the frac ports 26 are prevented. In addition, while in the closed position, the uphole and downhole ends of the tracer compartment 42 are similarly blocked by the valve sleeve 30 in order to contain the tracer material therein and prevent fluids flowing along the passage 14 to contact the tracer material.

Figure 18:
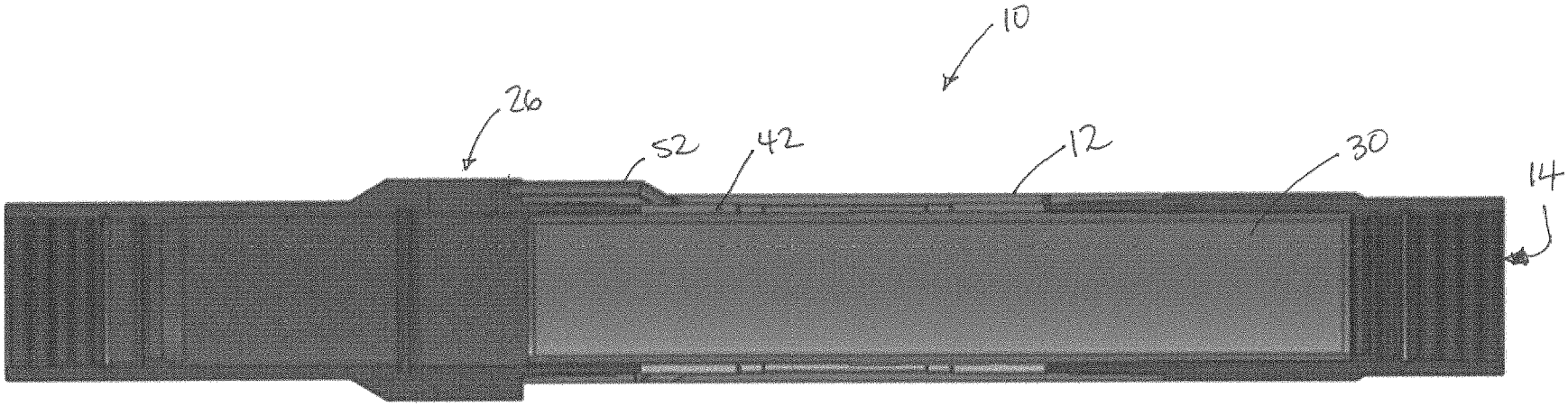

The valve sleeve 30 can be shifted downhole for operating the valve sleeve 30 in the open position, as seen in FIG. 18. As such, fluid communication is established between the passage 14 and the reservoir for either production or injection purposes.

In this implementation, each shunt 52 of the bypassing mechanism 50 can be provided with a flow regulator (not shown) configured to prevent fluid flow in at least one direction along the shunts 52. For example, the flow regulators can be check valves configured to prevent fluids from flowing from the tracer compartment 42, along the shunts 52, and into the frac ports 26 and reservoir. It is thus noted that fluid can typically flow along the shunts 52 during production operations as fluids enters the frac ports 26 from the reservoir. When in the open configuration, regular production operations can be initiated, effectively producing fluids through the frac ports 26 and up to surface. As seen in FIG. 18, the downhole end of the tracer compartment 42 remains sealed by the valve sleeve 30, therefore preventing tracer material to be carried to surface by production fluids which have entered the tracer compartment 42 via the shunt 52.

Figure 19:
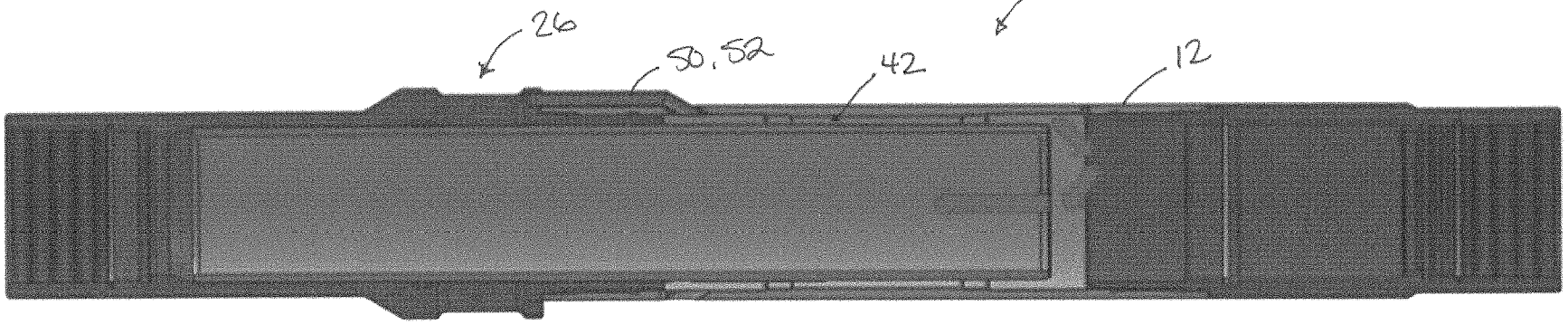

Moving the valve sleeve 30 to the tracing position effectively establishes fluid communication between the tracer compartment 42 and the passage 14. In this implementation, and as seen in FIG. 19, the valve sleeve 30 is shifted uphole in order to block the frac ports 26 while also uncovering the downhole end of the tracer compartment 42. It should be understood that blocking the frac ports 26 during production operations can effectively force all of the production fluids to flow through the shunts 52, and thus through the tracer compartment 42 for entraining tracer material. The downhole end of the tracer compartment 42 is illustratively in communication with the passage 14, such that fluids flowing towards the surface along the passage 14 can drag production fluids from the tracer compartment 42 into the passage 14 (e.g., create a venturi-type delivery system). It is appreciated that production fluids flowing into the tracer compartment 42 via the shunts 52 flow in a downhole direction prior to flowing into the passage 14, and finally uphole towards the surface.

Figure 20:
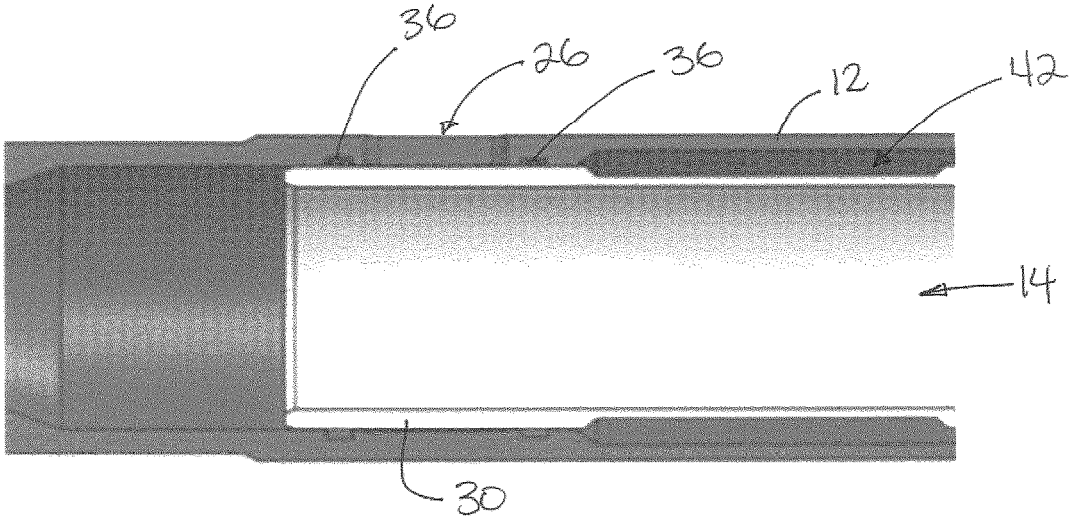
FIGS. 20 to 22 are cross-sectional views of a section of a valve assembly comprising a single valve.
Figure 21:
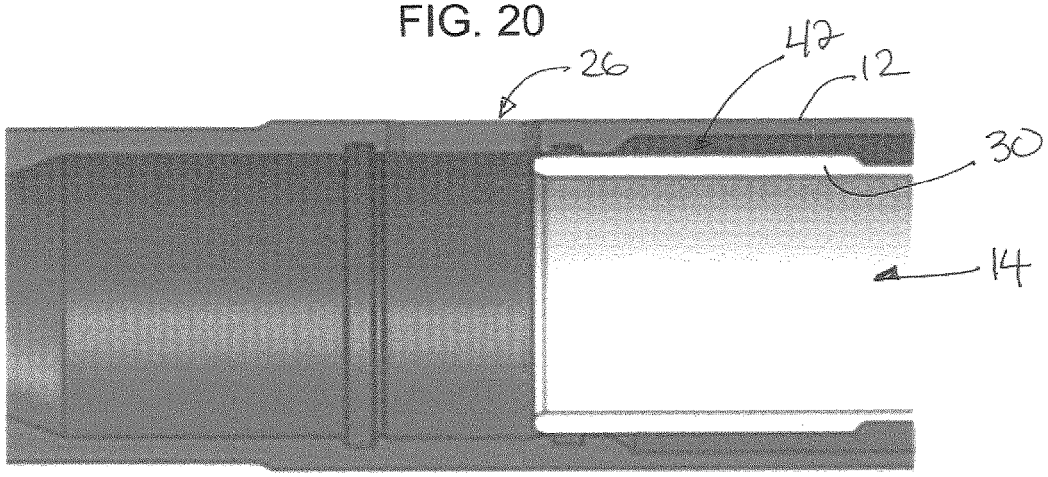
Figure 22:
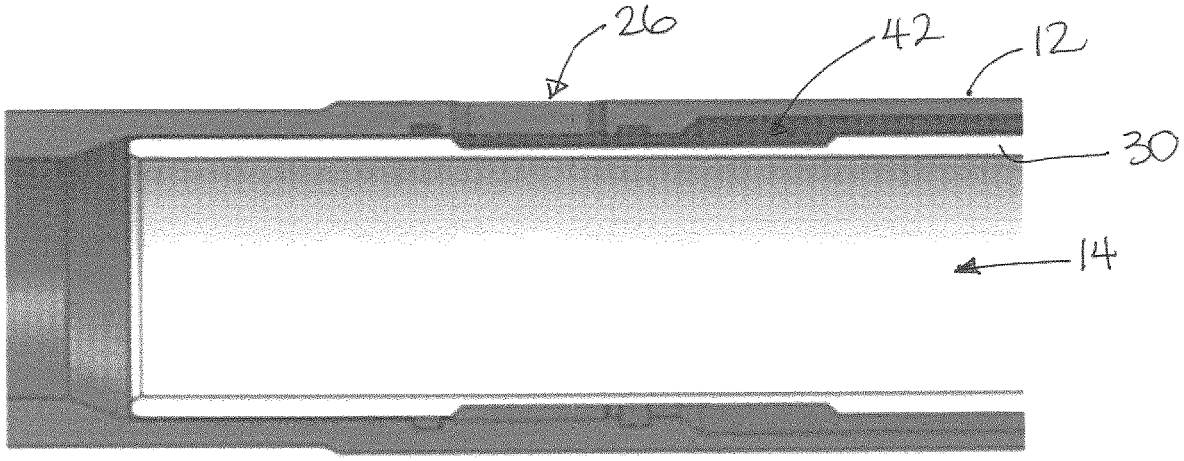

Now referring to FIGS. 20 to 22, another implementation of the valve assembly 10 comprising a single valve sleeve 30 is shown. In this implementation, the valve sleeve 30 is shaped and configured to block the frac ports 26 and seal the tracer compartment 42 when in the closed position (FIG. 20), open the frac ports 26 and maintain the tracer compartment 42 sealed when in the open position (FIG. 21), and establish fluid communication between the reservoir and the tracer compartment 42 when in the tracing position (FIG. 22). The valve assembly 10 can include retaining mechanisms (e.g., sealing rings 36, shear pins, etc.) adapted to prevent, or at least reduce, axial displacement of the valve sleeve 30 within the housing 12 prior to shifting the sleeve using a shifting tool, for example.

As seen in FIG. 20, the uphole portion of the valve sleeve 30 is shaped and sized to cover the frac ports 26 when in the closed position. Therefore, to uncover the frac ports 26, the valve sleeve 30 is shifted downhole in the open position, as seen in FIG. 21. The uphole portion remains engaged with the interior surface of the housing 12 to maintain the tracer compartment 42 sealed and isolated from fluid flowing into the frac ports 26 and along the passage 14. In this implementation, the valve sleeve 30 includes an inlet portion 40 having a reduced diameter such that, when in the tracing position, the inlet portion 40 is positioned opposite the frac ports 26 to facilitate the inflow of fluid within the tracer compartment 42 during production. In this implementation, the inlet portion 40 is provided proximate the uphole end of the valve sleeve 30, such that shifting the valve sleeve uphole effectively positions the inlet portion 40 opposite the frac ports 26, as seen in FIG. 22. Therefore, it is appreciated that production fluids can enter the housing 12 through the frac ports 26 and flow into the tracer compartment 42 via the inlet portion 40 provided at the uphole end of the valve sleeve 30. The production fluid then flows along the tracer compartment 42 in a downhole direction (i.e., towards the downhole end of the tracer compartment 42) into the passage 14. Once in the passage 14, production fluids containing tracer material are produced uphole towards surface.

Figure 23:
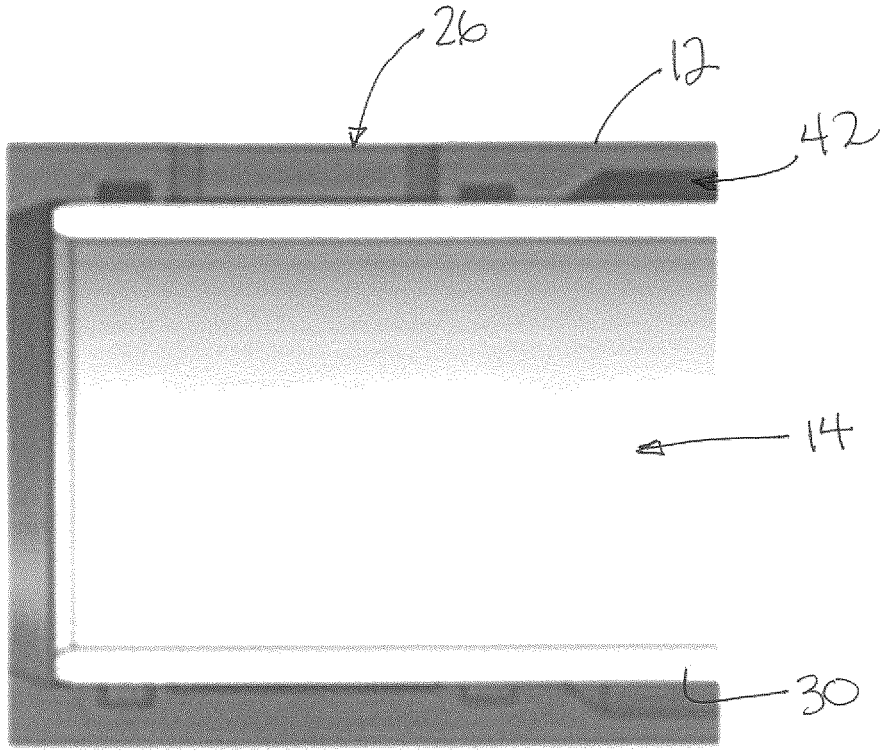
FIGS. 23 and 24 are cross-sectional views of a frac port of a single valve assembly, showing the valve in the closed configuration (FIG. 23) and in the tracing configuration (FIG. 24), according to possible implementations.
Figure 24:
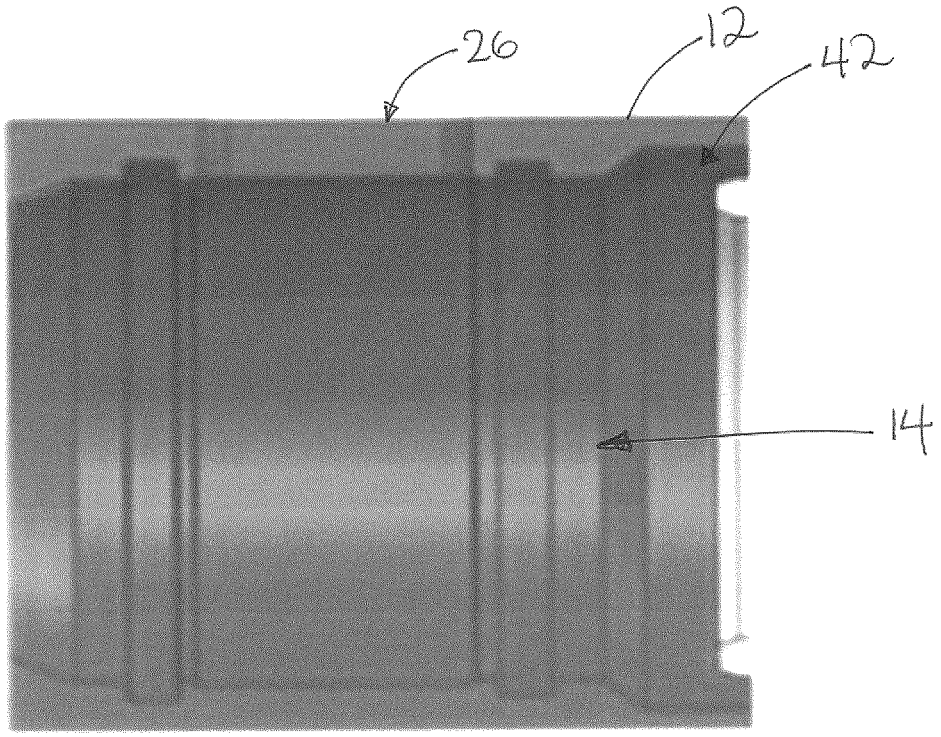

In other implementations, and with reference to FIGS. 23 and 24, the valve assembly 10 can include a single valve sleeve 30 operable in a similar manner as previously described. For example, the valve sleeve 30 can be operated in a closed position (FIG. 23), where the frac ports 26 are occluded and the tracer compartment 42 is sealed within the housing 12, an open position to enable fracturing operations (not shown here), and a tracing position (FIG. 24) where fluid communication between the tracer compartment 42 and the passage 14 is established. However, in this implementation, and as seen in FIG. 24, the valve sleeve 30 is shifted downhole in order to be operated in the tracing position, with the uphole end of the tracer compartment 42 opening into the passage 14 of the valve. It should be noted that, in this implementation, production fluid does not flow directly through the tracer compartment 42. Therefore, tracer material can enter the passage 14, to be produced along with production fluids, by any suitable method, such as by diffusion or any of the previously described mechanisms (e.g., a venturi-type system).

It will be appreciated from the foregoing disclosure that there is provided a valve assembly, which can define two mutually isolated fluid pathways for respectively fracturing the wellbore and tracing the production fluid. The valve assembly further allows for each stage of the wellbore to be monitored and diagnosed for the production of water, for example, during production of the wellbore. The monitoring enabled by the valve assembly and associated methods can facilitate qualitative determinations (e.g., whether or not water is being produced by a certain stage; whether or not oil or any fluids are being produced by a certain stage, etc.). In some implementations, the monitoring includes quantitative analyses of flow rates and fluid composition to provide a more detailed assessment regarding the production at one or more stages. The quantitative analyses can be facilitated by providing controlled and pre-determined geometries and flow conditions within the tracer compartment, as well as correlations or relationships between variables—such as tracer type, desorption rates, flow rates, fluid compositions, etc., based on the detected tracer concentrations in the production fluid.

The above-described valve assembly allows for providing tracer material in a frac sleeve device such that the tracer is pre-installed within the well, rather than pumped downhole into the formation from surface. The valve assembly therefore prevents tracer particulates from settling out in the surface equipment, and further prevents (or at least reduces) the risk of contamination of the tracer material since it can remain sealed within the tracer compartment prior to production. Additionally, the use of tracer material having low detection levels (e.g., oligonucleotides) can enable smaller volumes of tracer being used and increasing the lifespan of the tracer within the compartment.

It is also noted that, for disclosure purposes, the figures can be viewed as disclosing relative sizes and proportions of the components illustrated therein. Of course, these sizes and proportions should not be viewed as limiting, as various other relative sizes, shapes, proportions and other features can be used within the context of the present technology.

It should be noted that, in the above description, the same numerical references refer to similar elements. Furthermore, for the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom. The implementations, geometrical configurations, materials mentioned and/or dimensions shown in the figures are optional, and are given for exemplification purposes only.

Moreover, in the context of the present disclosure, the expressions "valve assembly", "downhole tool", "frac sleeve", etc., as well as any other equivalent expressions known in the art can be used interchangeably, as apparent to a person skilled in the art. This applies also for any other mutually equivalent expressions and/or to any other structural and/or functional aspects of the above-described implementations of the valve assembly, such as "housing" and "casing" for example, as also apparent to a person skilled in the art. It should also be noted that expressions such as "connected" and connectable, or "mounted" and "mountable", may be interchangeable.

In addition, although the optional configurations as illustrated in the accompanying drawings comprises various components and although the optional configurations of the valve assembly as shown may consist of certain geometrical configurations as explained and illustrated herein, not all of these components and geometries are essential and thus should not be taken in their restrictive sense, i.e. should not be taken as to limit the scope of the present disclosure. It is to be understood that other suitable components and cooperations thereinbetween, as well as other suitable geometrical configurations may be used for the implementation and use of the valve assembly, and corresponding parts, as briefly explained and as can be easily inferred herefrom, without departing from the scope of the disclosure. For example, when in the closed configuration, the top sleeve can be configured to block the frac ports, while the annulus region can be defined between the bottom sleeve and the housing, among other possibilities.

The invention claimed is:

1. A fracturing and tracer-delivery valve assembly for integration within a wellbore string disposed within a hydrocarbon-containing reservoir, comprising:

a valve housing comprising a tubular wall defining a central passage therethrough and a plurality of frac ports extending through the tubular wall for establishing fluid communication between the central passage and the reservoir;

a bottom sleeve operatively mounted within the valve housing and slidable within the central passage between a closed position and an open position to selectively open the frac ports, the bottom sleeve having a channel therethrough; and a top sleeve operatively mounted within the valve housing uphole of the bottom sleeve, the top sleeve and the valve housing defining an annulus therebetween, the top sleeve having uphole and downhole ends and a channel provided therethrough and being slidable within the central passage between (i) a first position defining a first fluid pathway whereby fluid is flowable down into the central passage at an uphole end of the housing, through the channel of the top sleeve and into the reservoir via the frac ports, and (ii) a tracing position defining a second fluid pathway whereby fluid is flowable from the reservoir into the annulus, upward along the annulus, and then into the central passage of the valve housing proximate an uphole end of the top sleeve; and a tracer compartment defined within the annulus and accommodating a tracer material, wherein:

in the first position, the uphole and downhole ends of the top sleeve are in sealing engagement with the valve housing to define the tracer compartment as a sealed section of the annulus that is isolated from fluid flowing along the first fluid pathway, and in the tracing position, the tracer compartment forms part of the second fluid pathway.

2. The fracturing and tracer-delivery valve assembly according to claim 1, wherein, in the tracing position, the frac ports are in fluid communication with the reservoir and the annulus to establish flow into the annulus.

3. The fracturing and tracer-delivery valve assembly according to claim 1, wherein the top sleeve comprises a tubular wall provided with a plurality of production ports proximate the uphole end thereof for establishing fluid communication between the annulus and the central passage of the valve housing.

4. The fracturing and tracer-delivery valve assembly according to claim 1 , wherein the uphole and downhole ends of the top sleeve are in sealing engagement with the housing when in the first position to occlude the production ports and prevent fluid from entering the tracer compartment during flow of fracturing fluid via the first fluid pathway.

5. The fracturing and tracer-delivery valve assembly according to claim 1, further comprising a pair of sealing rings provided on either side of the frac ports and being configured to sealingly engage at least one of the top and bottom sleeves.

6. The fracturing and tracer-delivery valve assembly according to claim 5, wherein at least one of the sealing rings engages the top sleeve when in the tracing position, and wherein at least one of the sealing rings engages the bottom sleeve when in the closed position.

7. The fracturing and tracer-delivery valve assembly according to claim 1, wherein the top sleeve includes an inlet portion proximate the downhole end opposite the frac ports, the inlet portion being recessed to facilitate fluid flow from the reservoir to the annulus.

8. The fracturing and tracer-delivery valve assembly according to claim 1, wherein the tracer material is provided in a polymer matrix carrier within the tracer compartment.

9. The fracturing and tracer-delivery valve assembly according to claim 1, wherein the valve housing is cemented within the wellbore.

10. A method of fracturing a formation and tracing production fluid via a single downhole multifunctional valve assembly, comprising:

deploying the valve assembly within a wellbore provided in a hydrocarbon- bearing formation, the valve assembly being configured to define:

a fracturing fluid pathway into the formation; and an enclosed tracer compartment comprising a tracer material sealed therein;

delivering fracturing fluid into the wellbore and through the fracturing fluid pathway to enter and fracture the hydrocarbon-bearing formation;

closing the fracturing fluid pathway after fracturing;

opening the tracer compartment to provide a tracing fluid pathway for production fluid to flow from the hydrocarbon-bearing formation, along the tracer compartment to allow contact with and release of the tracer material, and then into the wellbore to enable flow up to surface.

11. The method according to claim 10, wherein the valve assembly has at least (a) a run-in or closed configuration wherein fluid is prevented from being injected into the reservoir, (b) a fracturing configuration where frac ports are open and fracturing fluid can be injected via the first fluid pathway into the reservoir, and (c) a tracing configuration where production fluid is allowed to flow through the second pathway and then up to surface.

12. The method according to claim 11, wherein the fracturing configuration further allows production of production fluid from the reservoir via the first fluid pathway in production mode without tracing.

13. The method according to claim 10, wherein deploying the valve assembly within a wellbore comprises cementing the valve assembly in the wellbore.

14. A fracturing and tracer-delivery valve assembly for integration within a wellbore string disposed within a hydrocarbon-containing reservoir, comprising:

a valve housing comprising a wall, a passage extending therethrough, and at least one frac port extending through the wall for establishing fluid communication between the passage and the reservoir;

a flow path sub-assembly disposed within the housing and configured to move between at least (i) a first position defining a first fluid pathway whereby fluid is flowable between the passage and the reservoir via the at least one frac port, and (ii) a tracing position defining a second fluid pathway whereby production fluid is flowable from the reservoir into the valve assembly and then up to surface, the flow path sub-assembly being adapted to move from the first position to the tracing position, and from the tracing position to the first position;

a tracer compartment present within and/or in fluid communication with the second fluid pathway in the tracing position, the tracer compartment accommodating a tracer material.

15. The fracturing and tracer-delivery valve assembly according to claim 14, wherein the housing is configured for being cemented into a wellbore.

16. The fracturing and tracer-delivery valve assembly according to of claim 14, wherein the flow path sub-assembly comprises displacement members that move to provide the first and second positions.

17. A fracturing and tracer-delivery valve assembly for integration within a wellbore string disposed within a hydrocarbon-containing reservoir, comprising:

a valve housing comprising a wall, a passage extending therethrough, and at least one frac port extending through the wall for establishing fluid communication between the passage and the reservoir;

a valve sleeve operatively mounted within the valve housing and displaceable within the passage between a closed position, an open position to open the at least one frac port and define a first fluid pathway whereby fluid is flowable through the passage and into the reservoir via the at least one frac port, and a tracing position defining a second fluid pathway whereby fluid is flowable from the reservoir into the valve assembly and then up to surface; and a tracer compartment defined within the second fluid pathway and accommodating a tracer material, wherein:

in the closed and open positions, the tracer compartment is sealed and isolated from fluid flowing along the first fluid pathway, and in the tracing position, the tracer compartment forms part of the second fluid pathway.

18. The fracturing and tracer-delivery valve assembly according to claim 17, wherein the valve sleeve is the only sleeve in the valve housing.

19. The fracturing and tracer-delivery valve assembly according to claim 17, wherein the valve sleeve is shiftable downhole from the closed position to the open position.

20. The fracturing and tracer-delivery valve assembly according to claim 17, wherein the valve sleeve is shiftable uphole from the closed position to the tracing position.

21. The fracturing and tracer-delivery valve assembly according to claim 17, further comprising a pair of sealing rings provided on either side of the frac ports and being configured to sealingly engage the valve sleeve.

22. The fracturing and tracer-delivery valve assembly according to claim 17, wherein the valve sleeve includes an inlet portion proximate the downhole end opposite the frac ports, the inlet portion being recessed to facilitate fluid flow from the reservoir to the tracer compartment via the frac ports.

23. The fracturing and tracer-delivery valve assembly according to claim 17, further comprising a bypassing mechanism configured to establish fluid communication between the reservoir and the tracer compartment independently form the valve sleeve.

24. The fracturing and tracer-delivery valve assembly according to claim 23, wherein the bypassing mechanism comprises at least one shunt having a shunt inlet communicating with the at least on frac port and a shunt outlet communicating with the tracer compartment for establishing fluid communication therebetween, and wherein the shunt extends along an exterior surface of the valve housing.

25. The fracturing and tracer-delivery valve assembly according to claim 24, wherein the shunt comprises a check-valve configured to prevent fluid flow within the shunt as fluid flows from the passage to the reservoir via the frac ports.

26. The fracturing and tracer-delivery valve assembly according to claim 23, wherein, when in the tracing position, the at least one frac port is occluded by the valve sleeve to force fluid flow within the tracer compartment via the bypassing mechanism.

* * * * *